US008357016B2

(12) United States Patent
Schumacher et al.

(10) Patent No.: US 8,357,016 B2
(45) Date of Patent: Jan. 22, 2013

(54) PLUG CONNECTOR WITH ADAPTER

(75) Inventors: Ralf Schumacher, Lemgo (DE); Michaela Muecke, Detmold (DE)

(73) Assignee: Weidmueller Interface GmbH & Co. KG, Detmold (DE)

( * ) Notice: Subject to any disclaimer, the term of this patent is extended or adjusted under 35 U.S.C. 154(b) by 0 days.

(21) Appl. No.: 13/124,876

(22) PCT Filed: Oct. 14, 2009

(86) PCT No.: PCT/EP2009/063418
§ 371 (c)(1),
(2), (4) Date: May 20, 2011

(87) PCT Pub. No.: WO2010/046293
PCT Pub. Date: Apr. 19, 2010

(65) Prior Publication Data

US 2011/0201228 A1 Aug. 18, 2011

(30) Foreign Application Priority Data

Oct. 24, 2008 (DE) ..... 20 2008 014 168 U

(51) Int. Cl.
*H01R 4/36* (2006.01)

(52) U.S. Cl. ..... 439/814

(58) Field of Classification Search ..... 439/814, 439/798, 587, 589, 523, 810, 538, 578, 585, 439/350
See application file for complete search history.

(56) References Cited

U.S. PATENT DOCUMENTS

| | | | | |
|---|---|---|---|---|
| 3,402,382 | A * | 9/1968 | De Tar | 439/469 |
| 4,349,236 | A | 9/1982 | Guelden | |
| 4,820,204 | A * | 4/1989 | Batty | 439/681 |
| 5,409,400 | A * | 4/1995 | Davis | 439/607.48 |
| 5,839,703 | A * | 11/1998 | Tesar | 248/65 |
| 6,132,262 | A | 10/2000 | Blanchet | |
| 6,808,417 | B2 * | 10/2004 | Yoshida | 439/585 |

FOREIGN PATENT DOCUMENTS

| | | | |
|---|---|---|---|
| DE | 69402296 | T2 | 7/1997 |
| DE | 10044790 | C1 | 4/2002 |
| DE | 10108967 | C2 | 2/2003 |
| DE | 10236275 | B3 | 1/2004 |
| DE | 102008006046 | A1 | 7/2008 |
| EP | 0704934 | B1 | 7/2001 |
| EP | 0800238 | B1 | 10/2001 |
| EP | 1786071 | A2 | 5/2007 |

* cited by examiner

*Primary Examiner* — Tulsidas C Patel
*Assistant Examiner* — Phuongchi Nguyen
(74) *Attorney, Agent, or Firm* — Lawrence E. Laubscher, Sr.; Lawrence E. Lauscher, Jr.

(57) ABSTRACT

A plug and jack electrical connector arrangement for connecting together the conductors of a pair of cables, comprising a connector housing containing an open-ended chamber, a plurality of contacts adapted for connection with the bare ends of the conductors, and a contact mounting unit for mounting the contacts in the connector housing chamber, which mounting unit includes a contact support member containing a plurality of parallel longitudinal passages, a contact holder member arranged to retain the contacts relative to the contact support member, and a connecting arrangement connecting together the contact support and contact holder members. In one embodiment, the contact hold member contains a plurality of bores in alignment with the contact support member passages. In a second embodiment, the contact holder member contains a through passage for receiving the contact support member, thereby to retain certain contacts in external grooves contained in the support member.

17 Claims, 27 Drawing Sheets

PLUG CONNECTOR WITH ADAPTER

REFERENCE TO RELATED APPLICATIONS

This application is a continuation of the International Application No. PCT/EP2009/063418 filed Oct. 14, 2009, which was based on the German priority application No. DE 20 2008 014 168.0 filed Oct. 24, 2008.

BACKGROUND OF THE INVENTION

1. Field of the Invention

A plug and jack electrical connector arrangement for connecting together the conductors of a pair of cables, comprising a connector housing containing an open-ended chamber, a plurality of contacts connected with the bare ends of the conductors, respectively, and a contact mounting unit for mounting the contacts in a preassembled condition in the connector housing chamber.

2. Description of Related Art

Adapters of this typical kind make it possible to use the plug-in parts employed in them also in a rougher environment—for example, in production plants or vehicles—by attaining a protection class which is higher when compared to the protection class that is applicable to the plug-in part such as, for example, IP65 or IP67.

A typical arrangement for a telephone plug is known from the Guelden U.S. Pat. No. 4,349,236 (Bell Telephone Laboratories). The idea of meeting higher requirements arising from environmental classifications was further developed or anchored in IEC 61067-3-106 Variant 4, in EN 50173-1-: 2005, in ISO/IEC 24702 and in IEC 61918.

German patent No. DE 102 36 275 B3 displays a possibility of implementing these norms. This known design, of course, entails the problem that it is suitable only for the transmission of electrical signals and that, as a rule, it requires a larger space so that one can use this solution also for other plug parts, for example, those used in fiber-optic waveguide technology (for example, with SC-Simplex inserts, particularly at an interval of 7.35 mm) The known design furthermore should be improved with regard to high mechanical and chemical stresses, which it cannot really cope with in an optical fashion.

The in the European patent No. EP 1 786 071 A2, the receiving housing has a front receiving section for the plug part and a directly individually adjoining cylindrical section with an outer screw thread extending over a part of the axial length for the purpose of screwing on a nut for the cable duct. The nut furthermore has an inner screw thread extending over a part of its axial length and a sleeve section extending axially outward over the screw thread end, which has a somewhat larger inside diameter than the outside diameter of the cylindrical section, so that between the inside diameter of the sleeve section and the outside of the cylindrical section, there will be formed a ring-shaped space that is open in the direction of a plug-in front and that is axially closed off at the other end by the screwed-in screw thread in which ring-shaped space there engages a sleeve section of a sliding sleeve or an adapter sleeve arranged between the sliding sleeve and the nut.

Although this design proved to be effective, there is a need for creating an additional, possibly universally useful plug-in connection, which can be employed in a simple manner with and without supplementary adapter housing.

SUMMARY OF THE INVENTION

Accordingly, a primary object of the present invention is to provide a plug and jack electrical connector arrangement for connecting together the conductors of a pair of cables, comprising a connector housing containing an open-ended chamber, a plurality of contacts connected with the bare ends of the conductors, respectively, and a contact mounting unit for mounting the contacts in a preassembled condition in the connector housing chamber.

According to a more specific object, the contact mounting unit includes a contact support member containing a plurality of parallel longitudinal passages receiving the contacts, a contact holder member arranged to retain the contacts relative to the contact support member, and a connecting arrangement connecting together the contact support and contact holder members. In one embodiment, the contact holder member contains a plurality of bores in alignment with the contact support member passages. In a second embodiment, the contact holder member contains a through passage for receiving the contact support member, thereby to retain certain contacts in external grooves contained in the support member.

A further object is to provide a contact support member containing a plurality of parallel longitudinal passages, a contact holder member collinearly arranged relative to the contact support member, said contact holder member containing a plurality of through bores aligned with the passages, respectively, with the contacts extending through the passages and into the bores, respectively, and a connecting arrangement connecting together the contact support and contact holder members, thereby to define a contact mounting unit that is mounted concentrically within one end of the housing chamber.

According to a further object of the invention, the contact mounting unit is provided with shield means including a zinc bottom support plate.

The invention creates a plug-in connection with a first plug connector part and a second jack connector part, which have adapter housings that can in each case be stuck together and that can preferably be locked together with each other—in particular, they can be locked together or plugged together—and which again are used in the form of plug parts and jack parts that can be stuck together, whereby the plug part and the jack part have corresponding plug-in fronts that can be stuck together with a plug housing and a jack housing, which have a plurality of metallic, electrically conducting female and male contacts. The invention covers models of the plug-in connection without but especially also with adapter protection housings for the plug part and the jack part to achieve a higher sealing effect.

According to an important feature, the plug housing and/or the jack housing have a contact support member upon which are preassembled at least a part of the contacts—that is to say, at least one of the contacts or several—or all contacts and which on a contact holder after a preassembly of the contact or the contacts preferably can be moved out of a preassembly position for the assembly of the contacts with the contacts in a final assembly position. A particular advantage of this arrangement resides in the thus achievable easy and secure assembly of the contacts, which are preferably made as male pin-type and female sleeve contacts that are attached, for example, crimped upon, at the conductor ends of a cable initially on the contact support, which thereupon can be moved, in particular, can be shifted with the contacts into a final assembly position.

This can be done in a particularly simple and reliable fashion in that the contact support can be locked on the contact holder in two positions that are longitudinally offset with respect to each other in the plug-in direction.

According to a preferred embodiment, the plug housing and the jack housing have a rectangular cross-section, whereby preferably several mutually parallel-aligned rows of electrical contacts are provided in order thus to create a particularly contact plug-in connector with a large number of contacts in a narrow space, which can be used for signals, energy or data.

It is practical and it involves a simple design when the contact support is made in the form of a frame and when it has a plurality of guide-sleeve-like and preferably slit and thus restrictedly elastically expandable passage openings through which passes a part of the contacts—at least one contact—or all contacts, whereby the contact or the contacts are fixed in the passage openings in a form-locking and/or force-locking manner.

According to another variant that further enhances the safety of the plug-in connection, the locking means between the contact support and the contact holder can be blocked in a simple or multiple fashion or is blocked in the final assembly position.

BRIEF DESCRIPTION OF THE DRAWINGS

Other objects and advantages of the invention will become apparent from a study of the following specification, when viewed in the light of the accompanying drawing, in which.

DETAILED DESCRIPTION OF THE INVENTION

Figure 1:
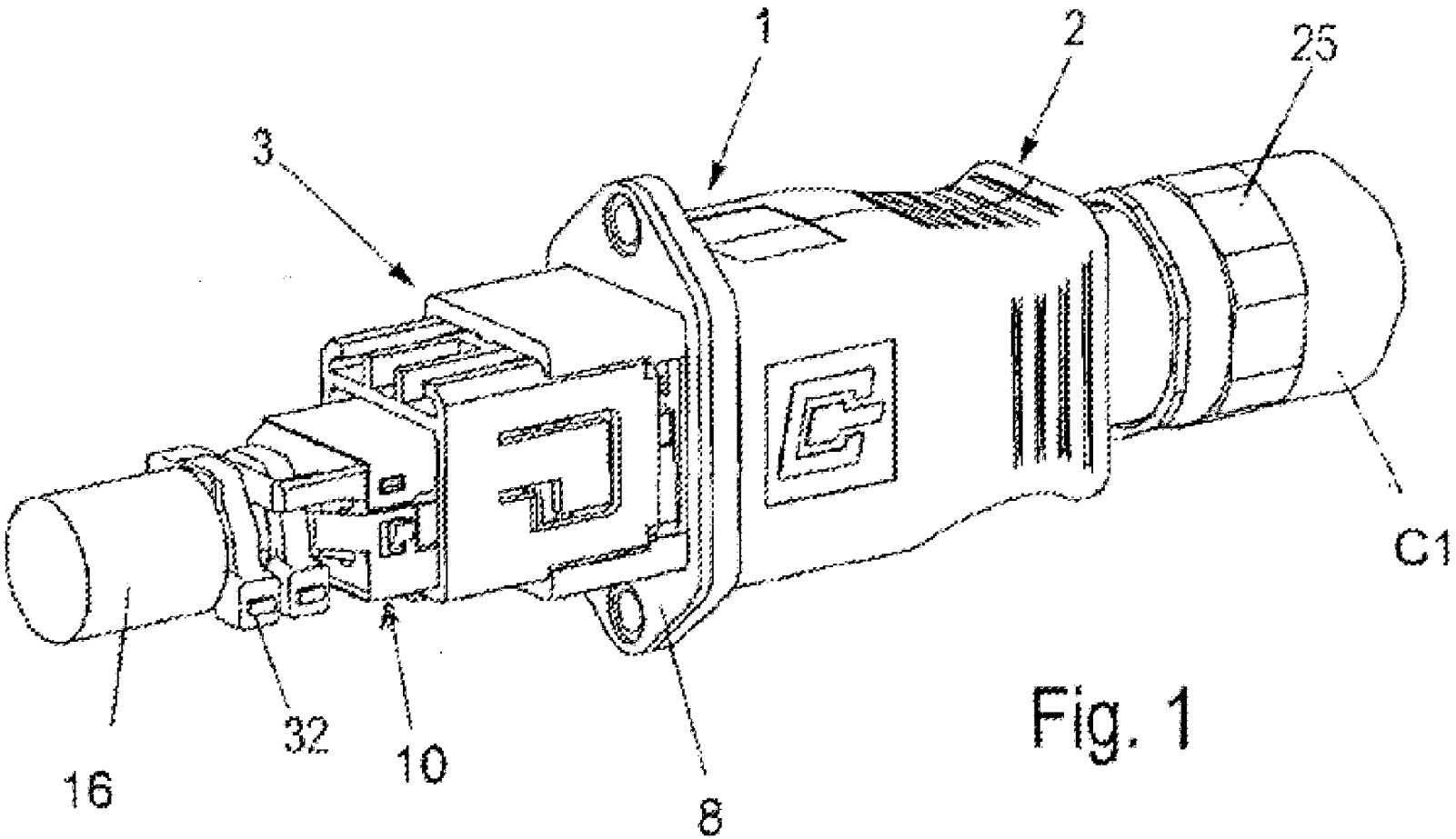
FIG. 1 is a perspective view of the plug and jack connector assembly of the present invention.
Figure 2A:
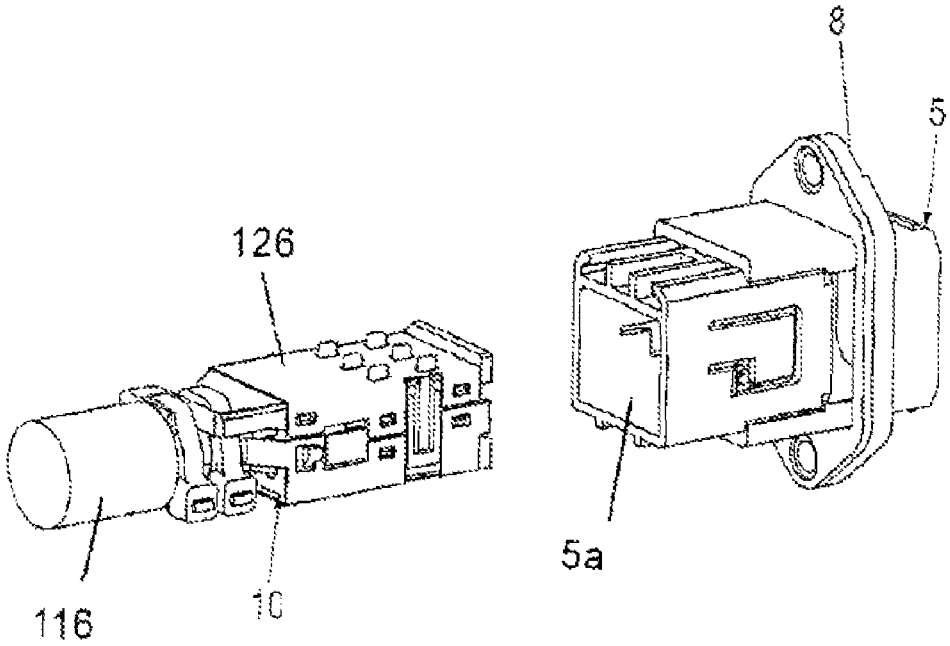
FIGS. 2*a* and 2*b* are exploded and assembled perspective views, respectively, of the jack connector.
Figure 2B:
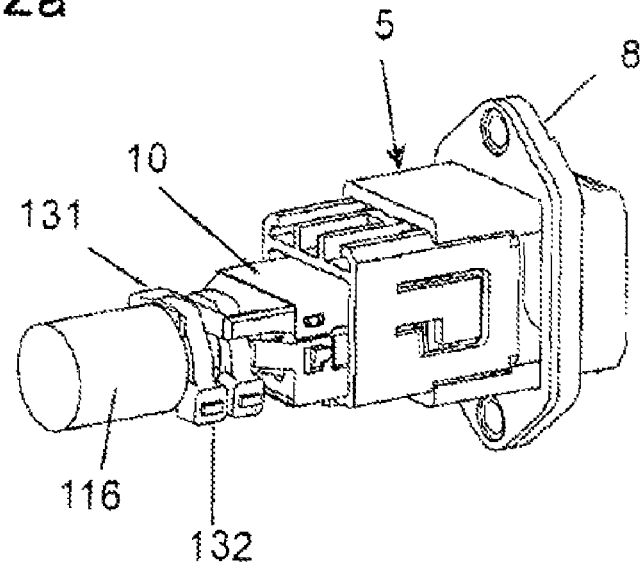
Figures 3A, 3B:
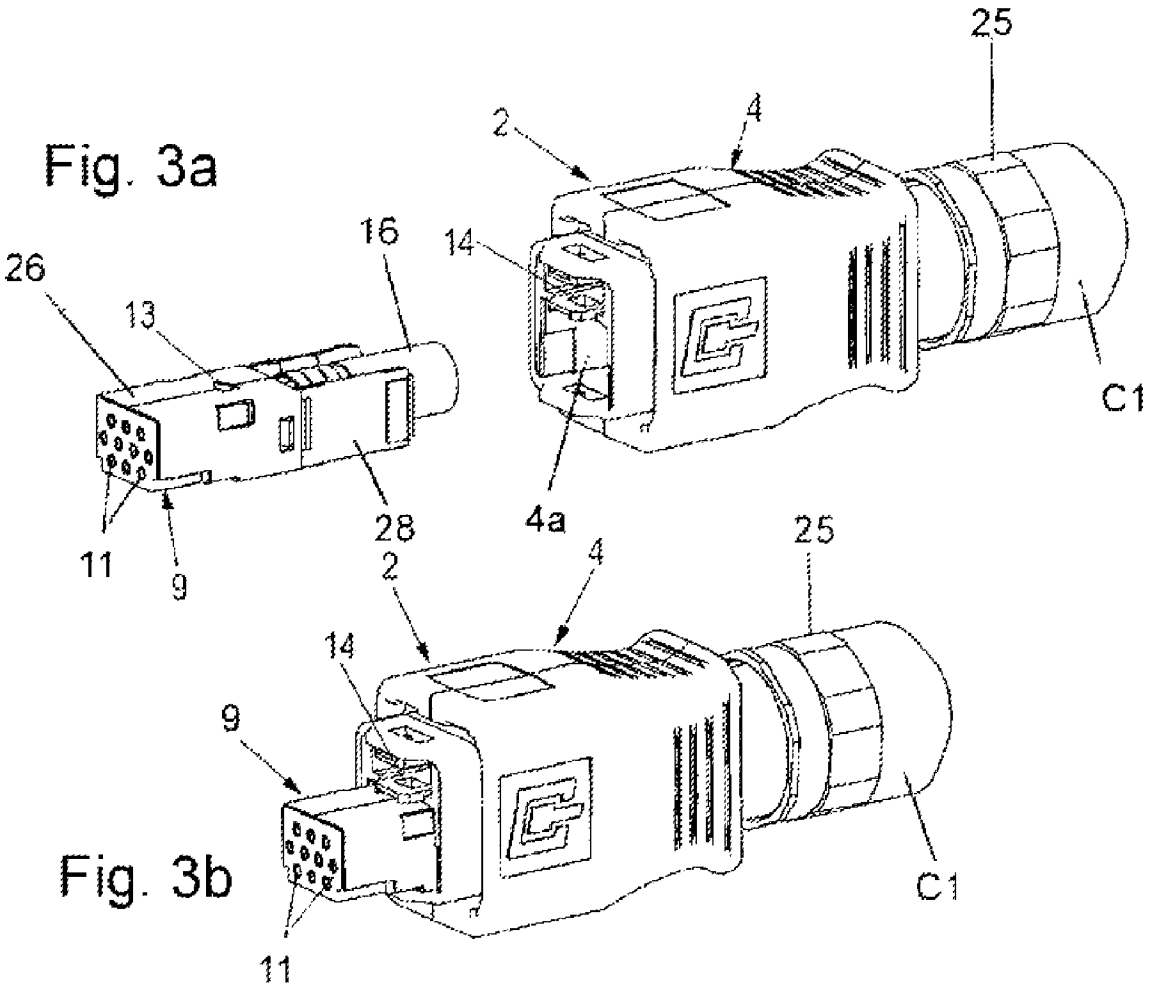
FIGS. 3*a* and 3*b* are exploded and assembled perspective views, respectively, of the plug connector.

Referring first more particularly to FIG. 1, the connector arrangement 1 of the present invention includes a plug connector 2 and a jack connector 3 for connecting together the conductors contained within cable 116, and within cable 16 (FIG. 3) having an outer cable sheath C1. As shown in FIGS. 2*a* and 2*b*, in accordance with the present invention a preassembled jack contact mounting unit 10 is provided for mounting the contacts of the conductors of cable 116 within the through opening 5*a* of jack housing 5. Similarly, as shown in FIGS. 3*a* and 3*b*, the preassembled plug contact mounting unit 9 serves to mount the contacts of cable 16 within the through passage 4*a* of plug housing 4. The jack housing has an outwardly extending flange portion 8 for mounting the connector assembly in an opening contained in a fixed support (not shown).

The plug and jack contact mounting units 9, 10 here in each case have a compact shape with a rectangular cross-section, whereby preferably several mutually parallel-aligned rows of electrical contacts 11, 12 are provided. In a particularly preferred embodiment, we provide ten of the contacts 11, 12 in three rows at two times three and one times four contact, which can be used for the transmission of data, electrical power line and/or signals. Because of the plurality of contacts 11, 12 in a narrow space, the plug-in connection 1 is outstandingly suitable for problems encountered in automation technology. It is furthermore advantageous to provide a traction relief for the cable, which can be done in a simple design by means of a cable screw connection 25 (on plug part 2) (FIG. 1).

Preferably, housings 4 and 5 (for example, provided with corresponding seals and the like) are designed for relatively high type of protection such as IP65 or more, while the interior plug and jack parts 9 and 10, which can also be plugged together without the adapter housings 4, 5, are designed for lower type of protection such as IP20, so that with the help of adapter housings 4, 5, it is possible to use the plug-in connection 1 also in a rougher environment, for example, in industrial production.

Figure 4:
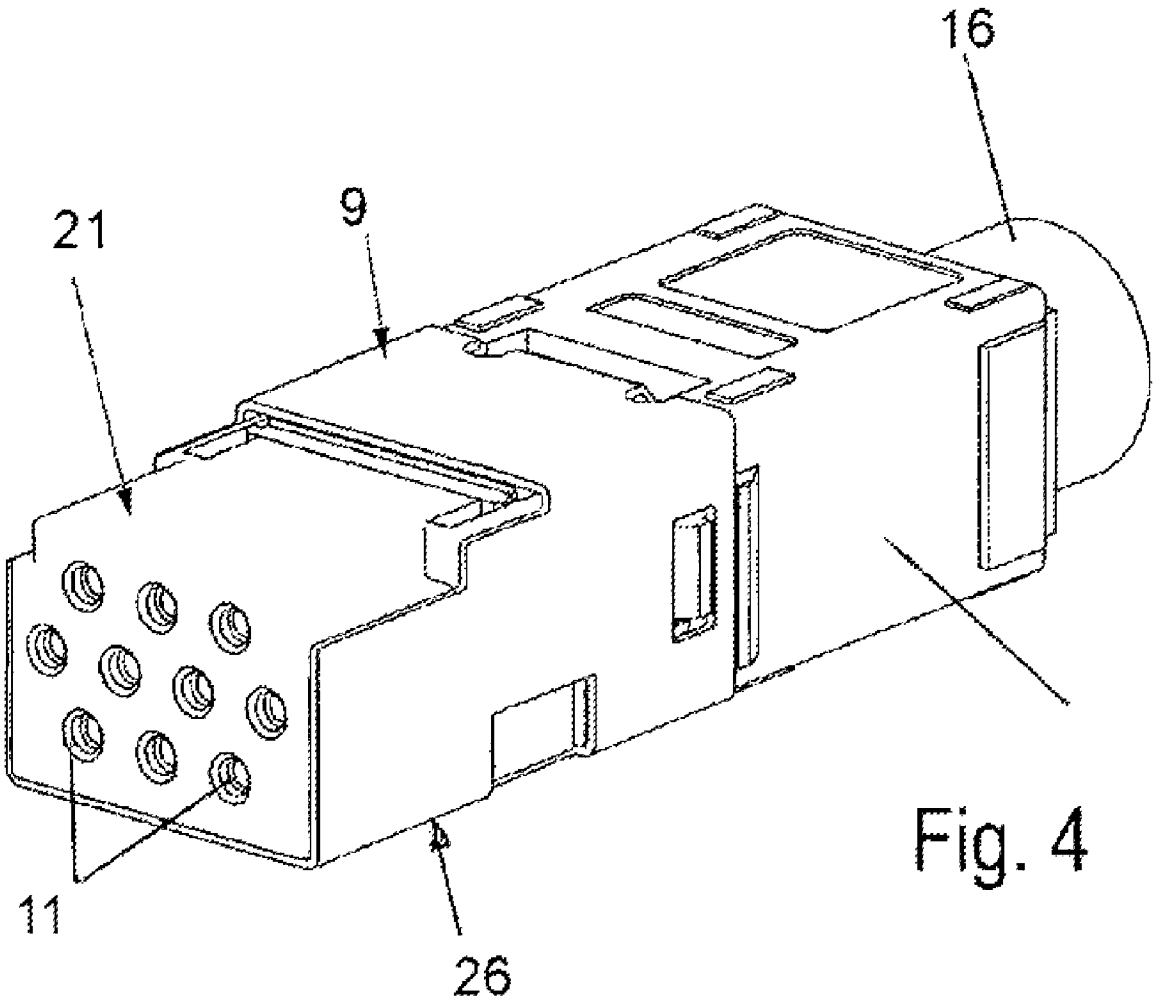
FIG. 4 is a perspective view of the assembled plug contact mounting unit.
Figure 5:
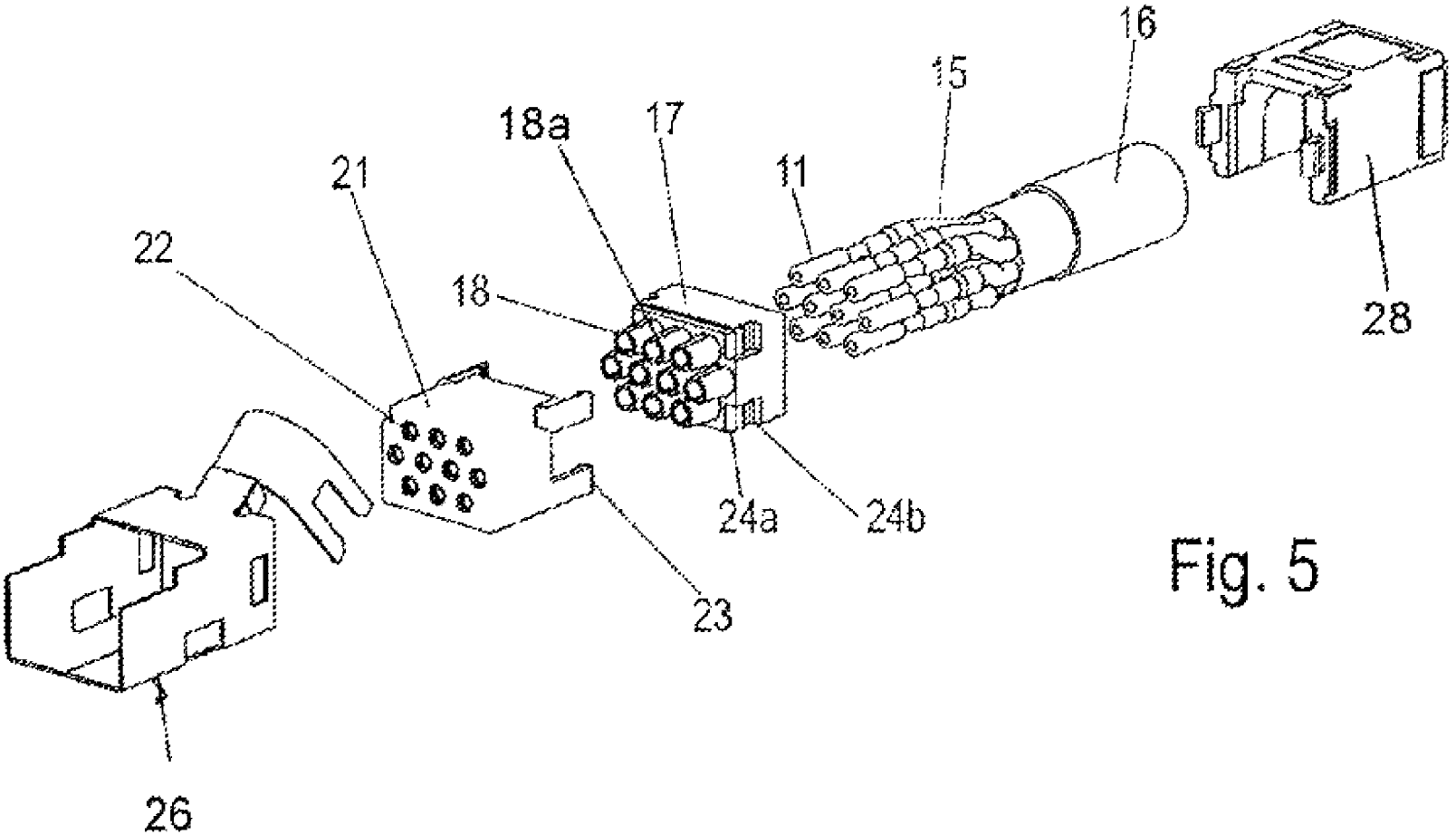
FIG. 5 is an exploded perspective view of the plug contact mounting unit.

Referring now to FIGS. 4 and 5, the plug contact mounting unit 9 includes a synthetic plastic contact support member 17 containing a plurality of openings 18 for receiving the female contacts 11 that are crimped upon the bare ends of the conductors 15 of cable 16. As will be explained in greater detail below, the orifices of the openings 18 terminate in resilient longitudinally-slit guide sleeves 18*a* that receive the ends of the female contacts 11, respectively. A synthetic plastic contact holder member 21 contains a plurality of corresponding openings 22 for receiving the tips of the guide sleeves 18*a*, respectively, and the ends of the contacts 11. Latch hooks 23 on the contact holder member 21 engage latch recesses 24*a* and 24*b* on the contact support member 17, thereby to lock together the adjacent ends of these members. Sheet metal shield means 26 serve to shied the assembled contact support and contact holder members, as will be explained below. An adapter member 28 is connected with the other end of the contact support member 17.

Figures 6A, 6B, 6C:
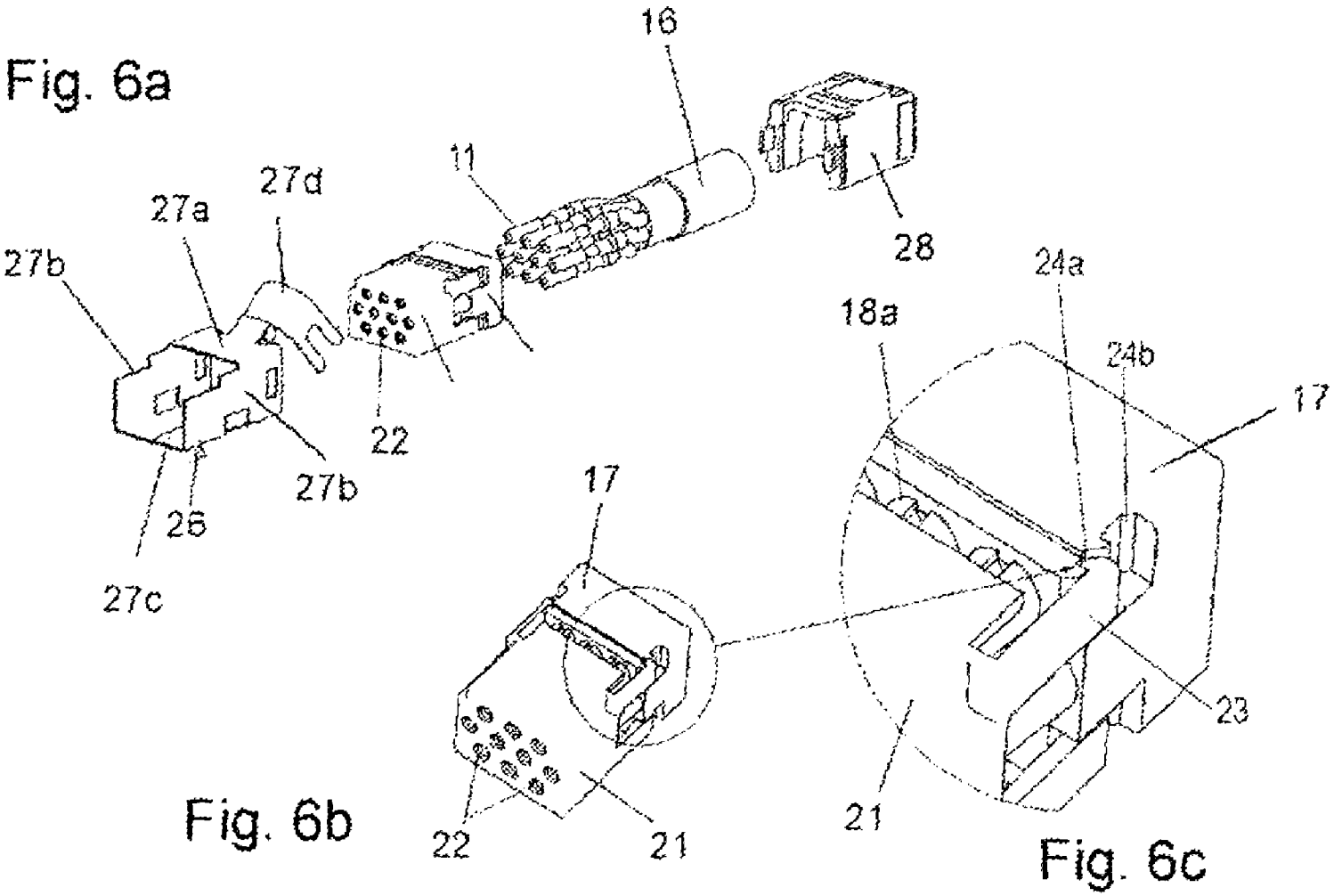
FIG. 6*a* is and exploded perspective view of the plug contact mounting unit in the partially-assembled condition.
FIGS. 6*b* and 6*c* are detailed views of the latch means of FIG. 6*a;*
Figures 7A, 7B, 7C:
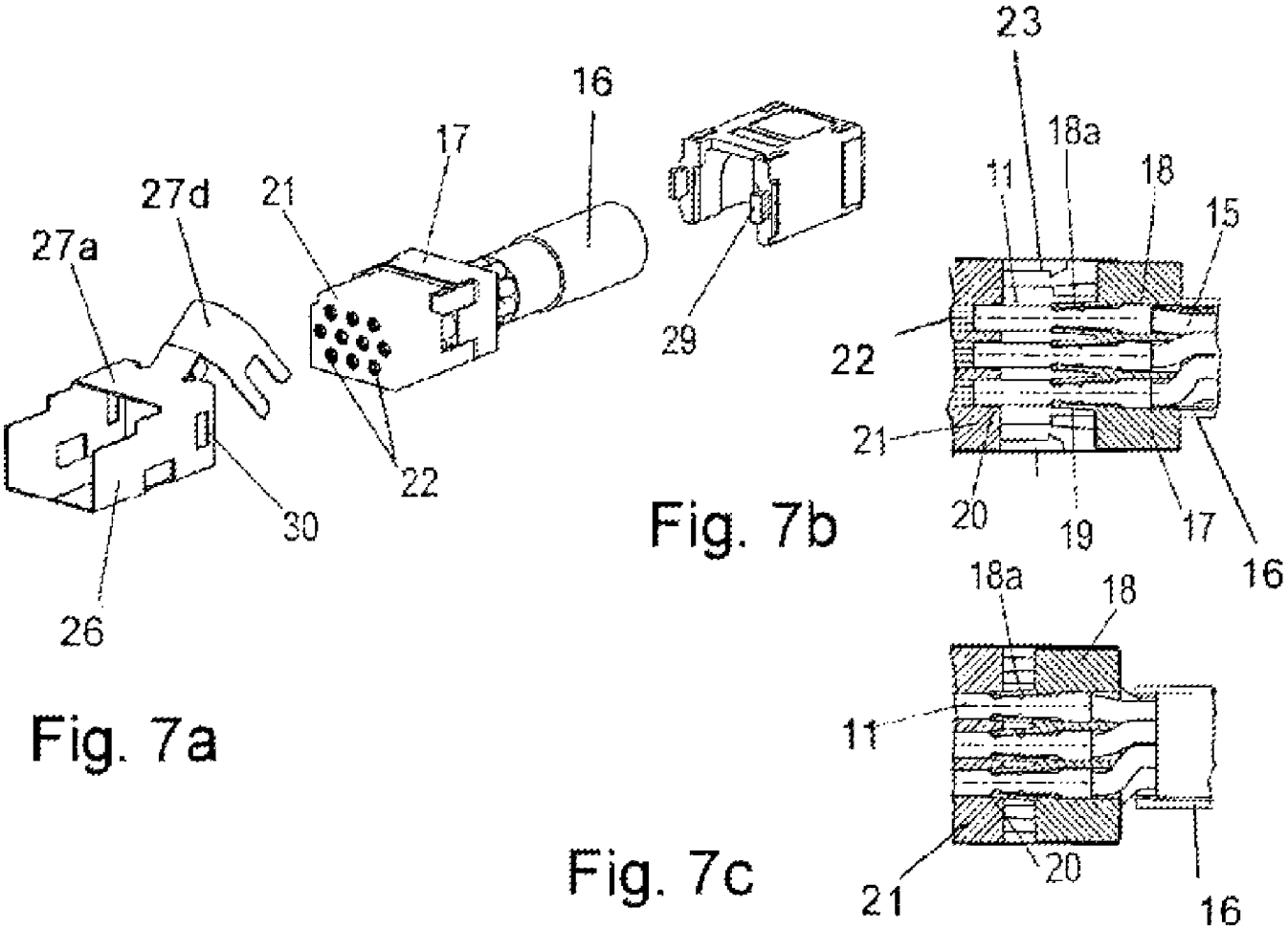
FIG. 7*a* is an exploded view of the plug contact mounting means in the fully assembled latched condition.
FIGS. 7*b* and 7*c* are detailed sectional views illustrating the contact support and contact holder members in the partially-assembled and fully assembled conditions.

As shown in FIGS. 6*a*, and 7*a*, during the assembly of the plug contact mounting unit 9, the contact support member 17 and the contact holder member 21 initially have a partially-assembled axially-spaced condition (FIG. 6*a*), and subsequently a fully assembled abutting condition (FIG. 7*a*). When in the initial partially-assembled condition, the locking hooks 23 (FIGS. 6*b* and 6*c*) on the contact holder member 21 extend within the recesses 24*a* on the contact support member 17. In this case, the tips of the female contacts 11 (FIG. 7*b*) extend partially into the passages 22 contained in the contact holder member 21. When the contact support and holder members are longitudinally displaced together into locked abutting engagement with the locking hooks in engagement with recesses 24*b*, the female contacts extend into the passages 22 as shown in FIG. 7*c*. The passages 22 have constricting funnel orifices 20 that cause the longitudinally-slit resilient sleeves 18*a* on the contact support member 17 to be force-fit into, and locked within, the passages 22.

To simplify the assembly, contact support 17 is arranged movably—in this case, in a sliding manner—on a contact holder 21 with duct openings 22 (FIGS. 5 to 7) upon which it can be latched in two positions that are longitudinally offset with respect to each other in the plug-in direction X, whereby in one of these two latching positions, it has a larger distance from the ducts 22 in contact holder 21 than in the others.

Contact support 17 can be pre-latched in the position in which it has a greater distance to the contact holder 21 (FIG. 6). This "preassembly position or pre-latching position" is intended quickly and securely to preassemble the conductor ends 15 with the female contacts 11 in a simple manner for which purpose the conductor ends 15 are stuck through the duct openings 18. The contact support 17, thus preassembled, is then shifted and moved into the second latching position with the female contacts 11 in the direction of the section of contact holder 21, which has the duct openings 22.

This can be done in various ways: For example, the latch hook 23 has sufficient length—in this case, four latch hooks—on one of the two structural parts 17, 21 so that contact support 17 or contact holder 21 can be latched together in two mutually longitudinally offset latch recesses 24*a*, 24*b* on the other of the two structural parts (FIG. 6*a, b, c*) or that different latching means are provided for the various positions, in particular, in a design that can be secured against shifting to differing degrees (not illustrated here).

After the preassembly of conductors 15, the contact support is simply pushed out of the "pre-latching position" shown in FIG. 6 into the "latching position" shown in FIG. 7. The guide-sleeve-like projections 18*a* on the duct openings can be so designed that in this state, they will so dip into funnels 20 or several corresponding contours in contact holder 21 that we can prevent the widening of bridges 18 through contact holder 21 to the outside and so that in this way the latching of the jack contacts 11 in the contact support 17 will be locked in.

It is further conceivable that plug part 9 is thus directly inserted into adapter housing 4 or using a supplementary part such as an auxiliary adapter member 28 (FIG. 8) that extends its axial length or an intermediate housing. Here, the auxiliary adapter member 28 is firmly latched on the screen housing 26 for which purpose again we use corresponding latch means such as latch hooks 29 and latch recesses 30.

Figure 8:
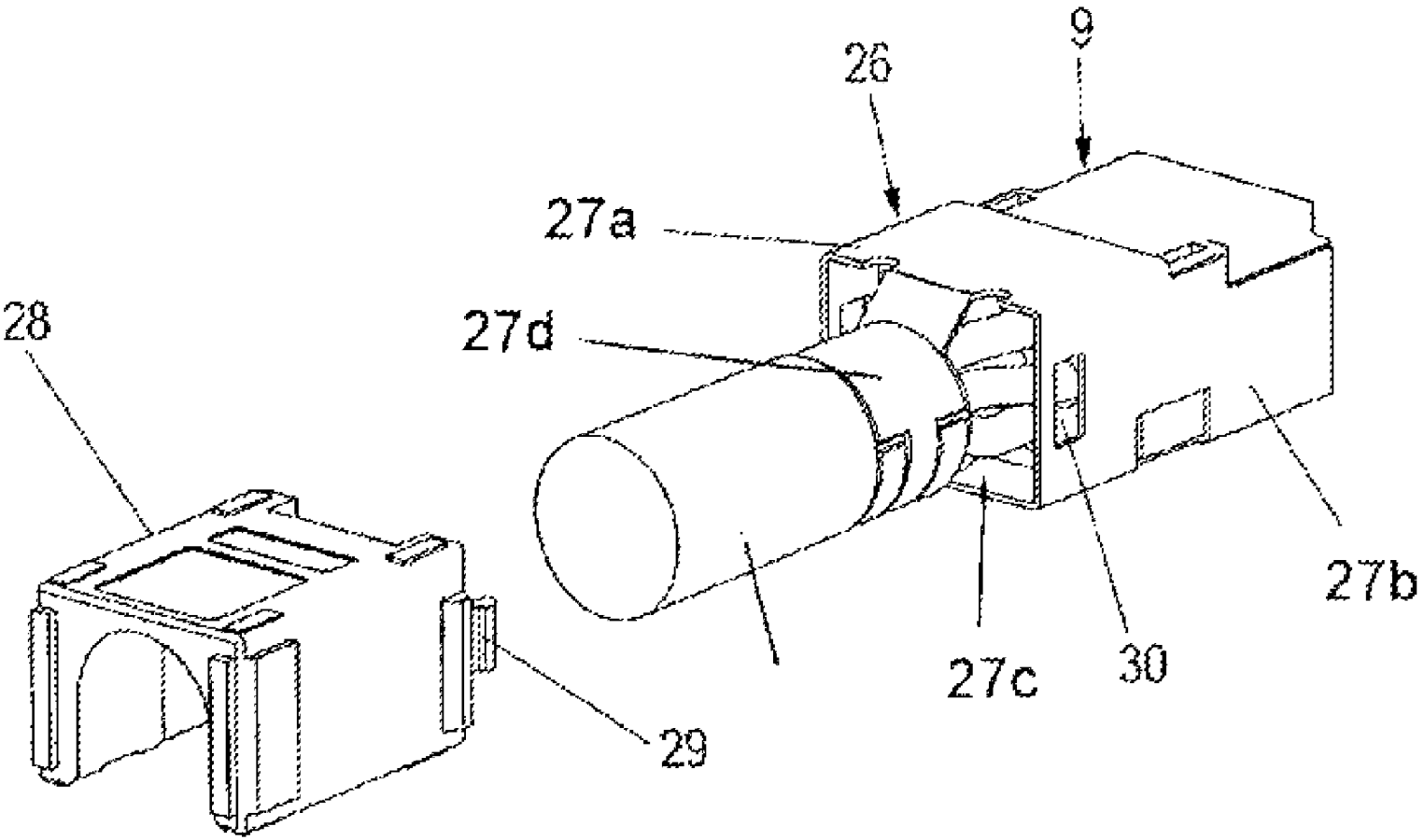
FIG. 8 is an exploded perspective view of the plug assembly.

Following the assembly of the contact support and contact holder members 17 and 21, rectangular sheet metal shield means 26 are mounted concentrically about the plug contact mounting unit 9. The shield means comprises a sheet metal member having top, side and bottom walls 27*a*, 27*b* and 27*c*, respectively. Attached to one end of the top wall 27*a* is a stabilizing fastening flap 27*d* that is bent downwardly toward, and is wrapped around, the cable 16, as shown in FIG. 8. An auxiliary adapter member 28 is then connected with the plug connector mounting unit by latch projections 29 and latch openings 30.

Preferably, the latch hooks 23 are blocked in the terminal latching position in which the contact support 17 is axially closer to the contact holder 21 with the duct holes. This function can be implemented, for example, with the help of the screen housing 26 when the screen sheet metal pieces 27 are so shaped that, when in the assembled position, they will so cover the latch hooks 23 toward the outside circumference that they cannot move out of the latch recesses 24 (in analogy to FIG. 15, which is to be described with regard to the jack part). Jack housing 10 has a corresponding design.

Figure 9A:
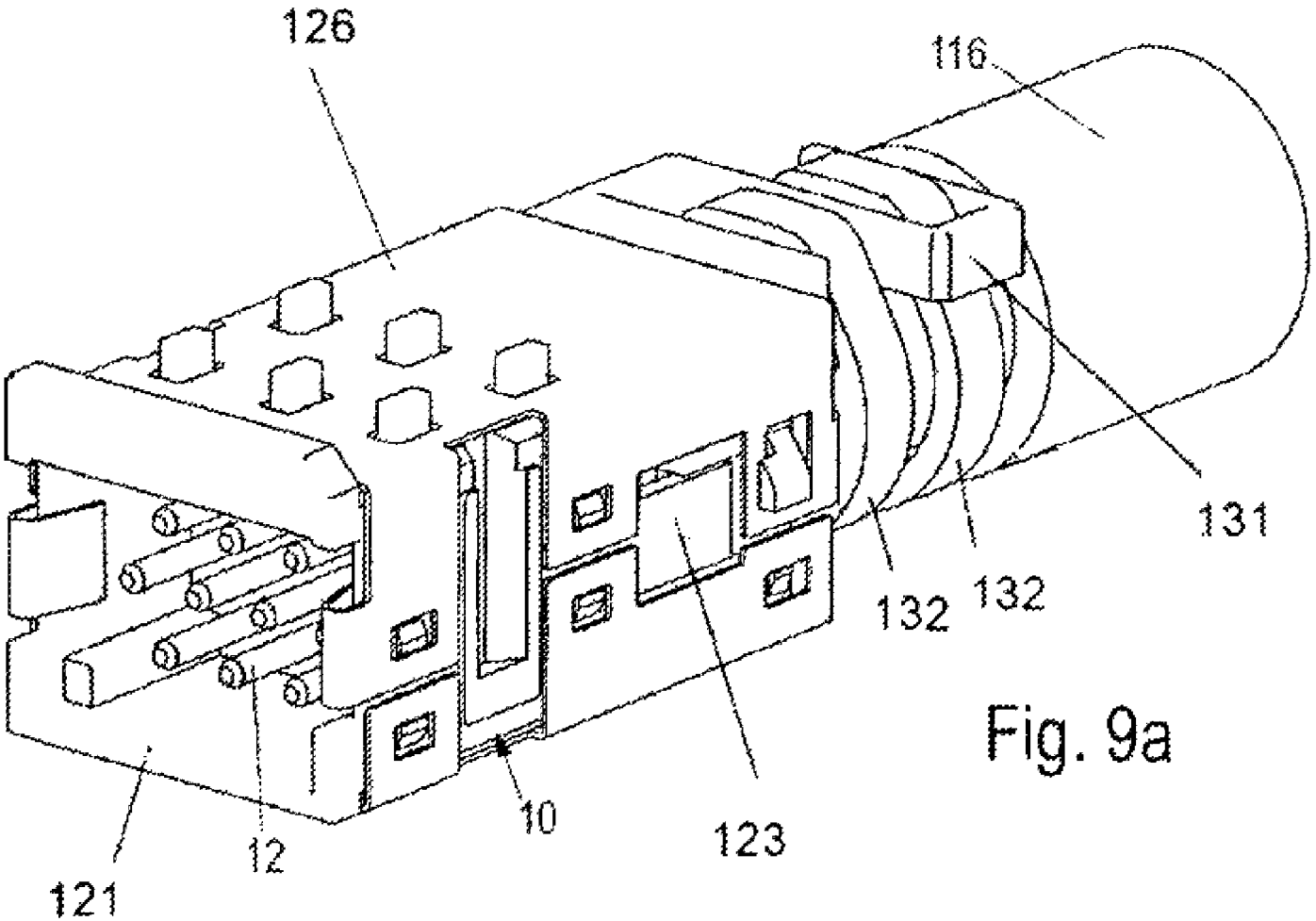
FIGS. 9*a* and 9*b* are front and rear perspective views of the jack connector.
Figure 9B:
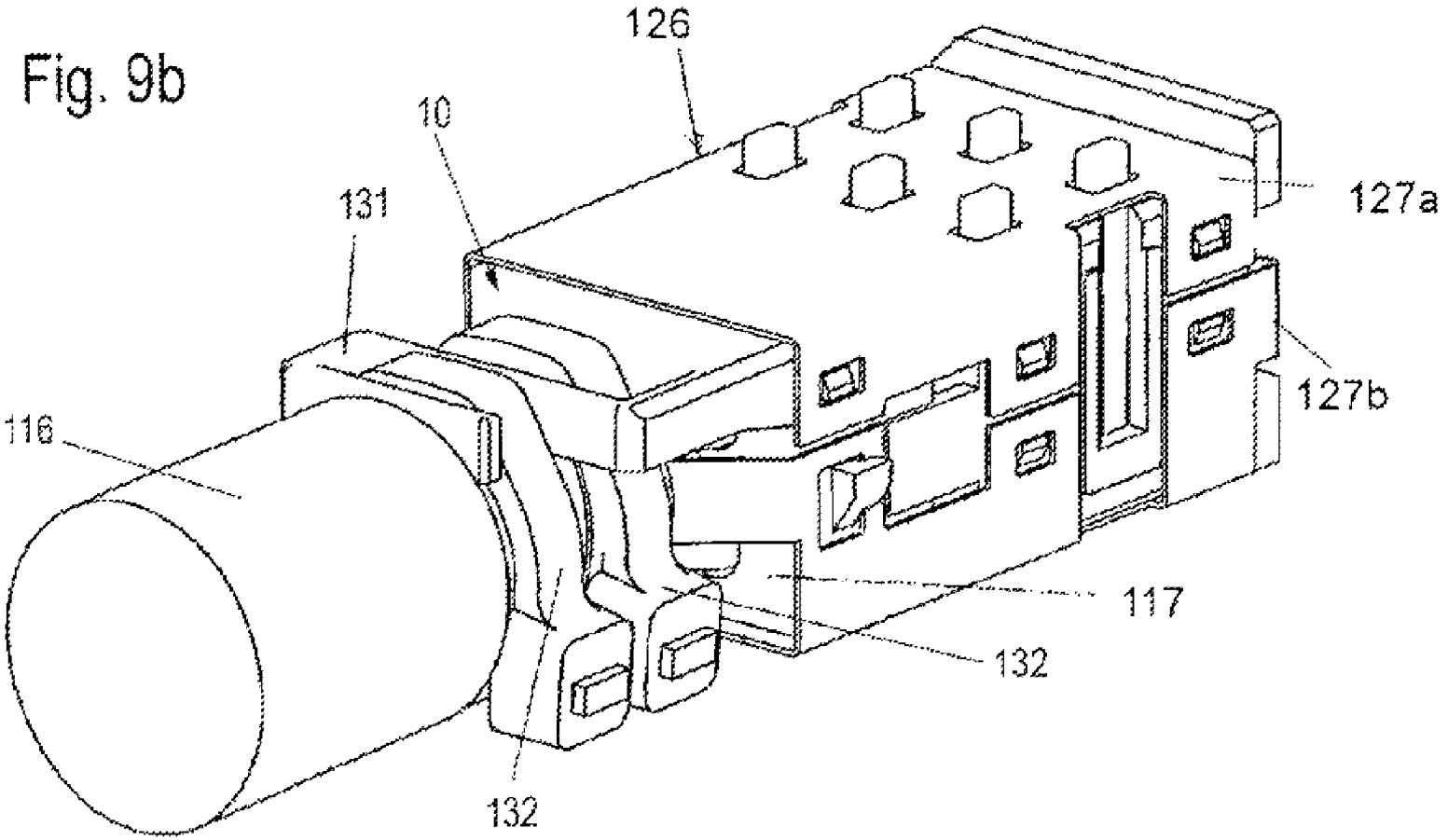
Figure 10A:
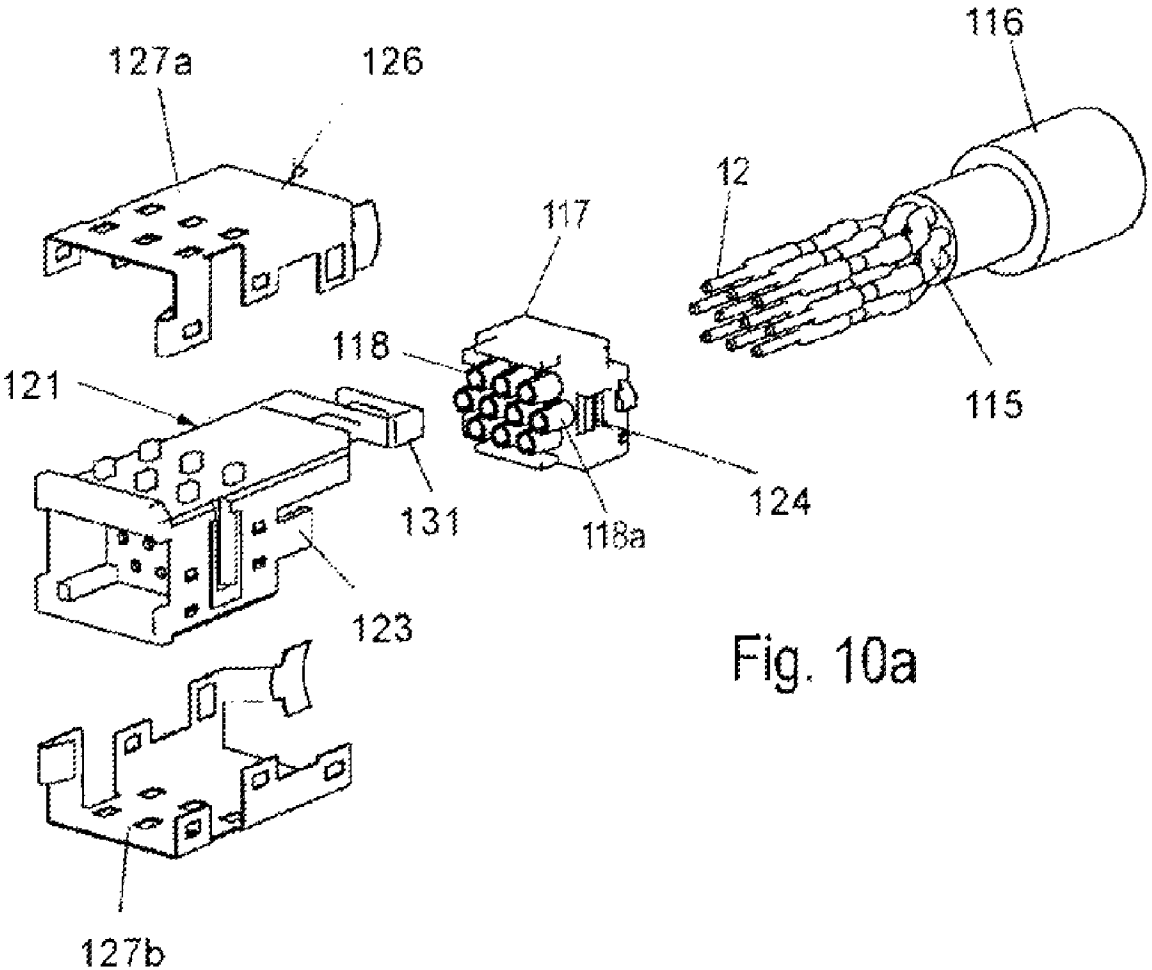
FIG. 10*a* is and exploded view of the jack contact mounting unit.
Figures 10B, 10C:
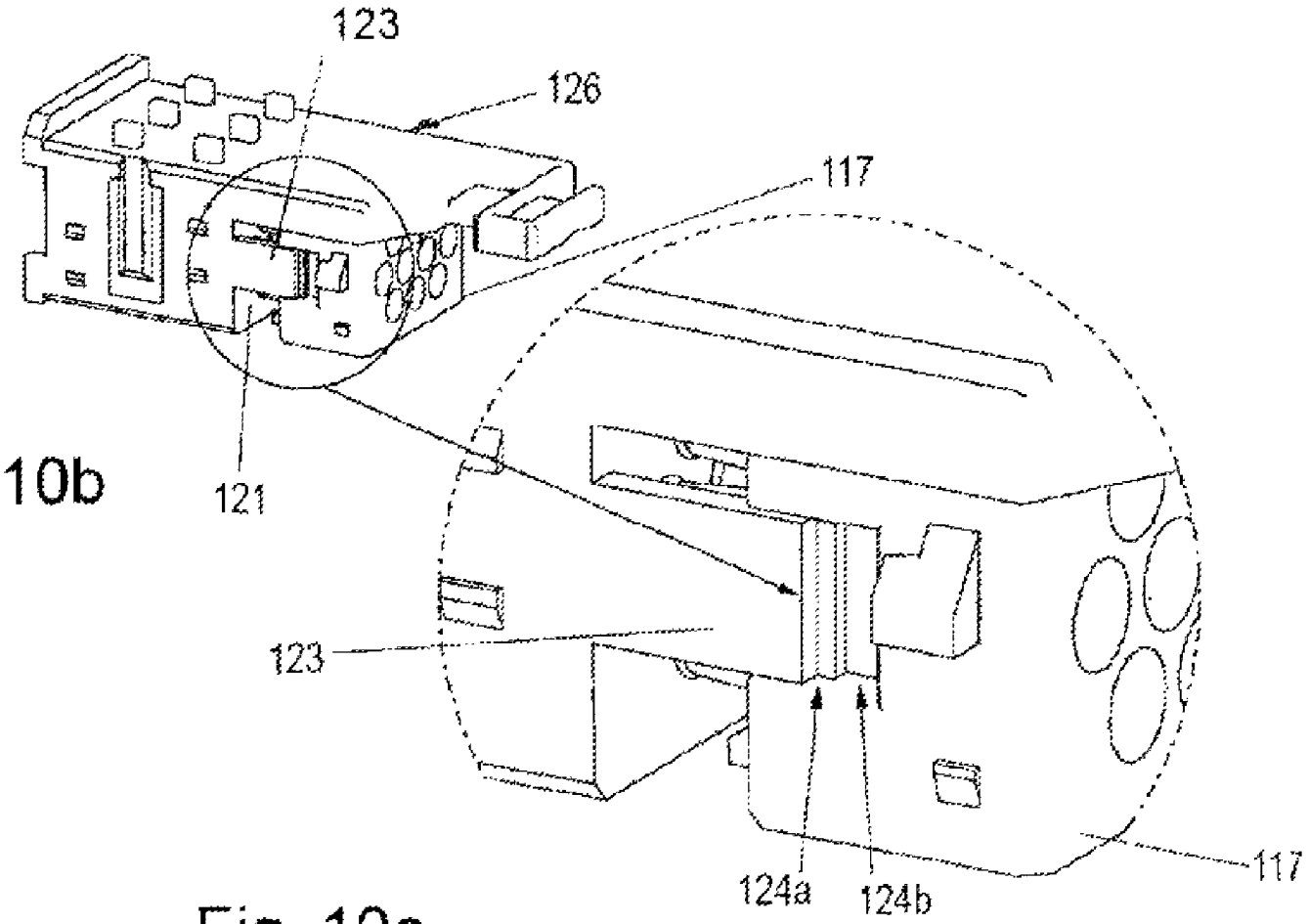
FIGS. 10*b* and 10*c* are rear perspective and detailed perspective views of the latch means of the jack contact mounting unit.
Figure 11:
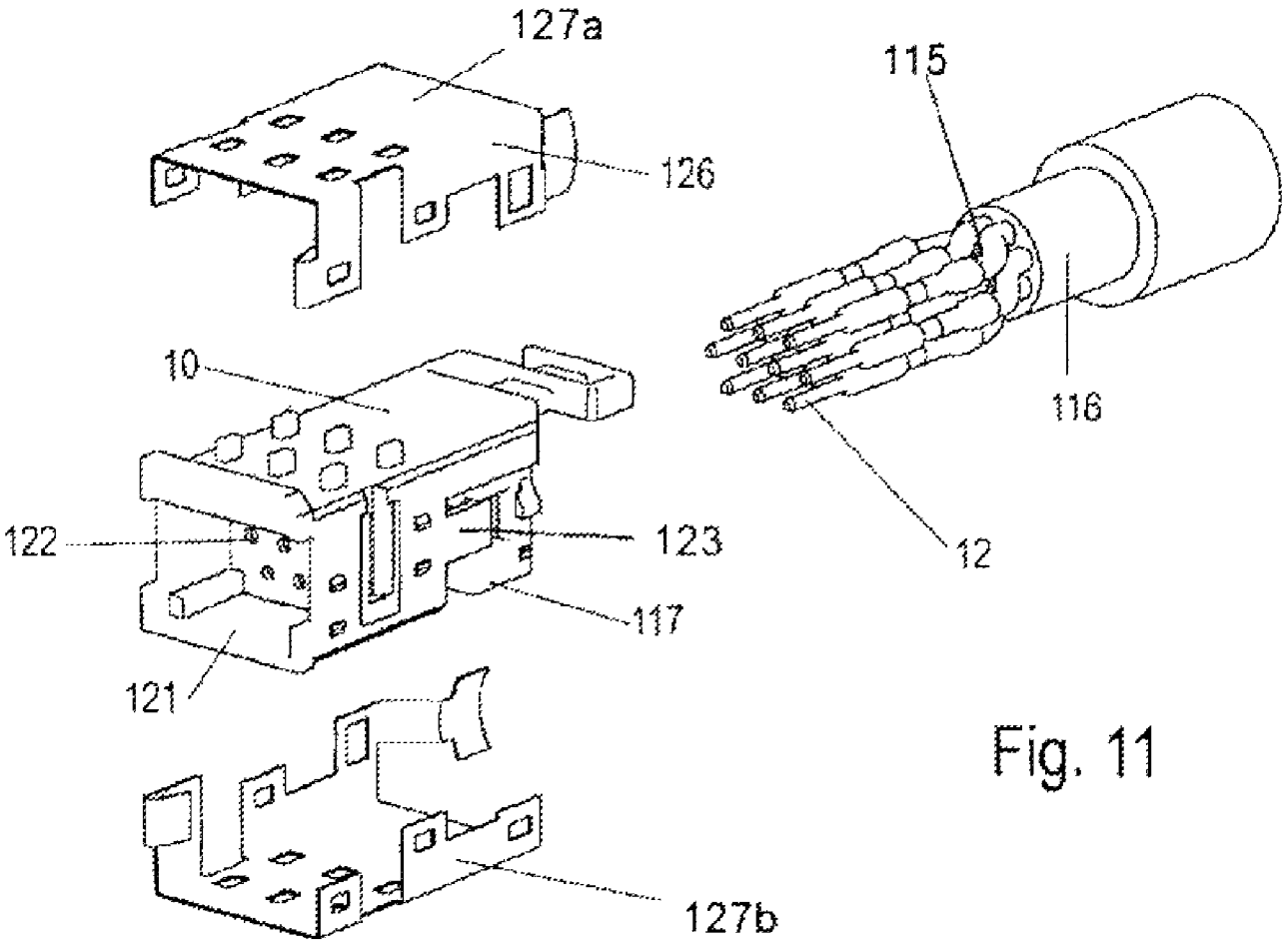
FIG. 11 is an exploded perspective view of the jack connector.

Similarly, as shown in FIG. 2, the preassembled jack contact mounting unit 10 is arranged for insertion within the chamber 5*a* of the jack housing 5. In FIGS. 9*a* and 9*b*, it will be seen that the jack contact mounting unit 10 includes sheet metal shield means 126 extending around the assembled contact support member 117 and the contact holder member 121. Referring to FIGS. 10*a*-10*c*, the synthetic plastic contact holder 117 contains passages 118 that receive the male contacts 12 that are crimped upon the bare ends of the conductors 115 of the cable 116. As before, the resilient longitudinally-slit sleeves 118*a* are adapted for insertion within the through passages 122 (FIG. 12*a*), respectively, contained in the contact holder member 121. Latch portion 123 and latch openings 124*a*, 124*b* (FIGS. 10*b* and 10*c*) cooperate to lock together the contact support and contact holder members in the full assembled condition. In this case, the sheet metal shield means 126 includes upper and lower U-shaped sheet metal members 127*a* and 127*b* (FIGS. 10*a* and 11). Prior to mounting the shield means 126, the contact support member 117 and the contact holder member 121 are displaced together to the fully assembled latched condition of FIGS. 12*b*, 13, 14 and 18. The stabilizing fastening tabs 127*d* are bent around the cable 116, and fastening rings 132 cooperate with the fastening extension portion 131 to rigidly connect the jack contact mounting unit 10 to the cable 116, as shown in FIGS. 2*a* and 2*b*.

To simplify assembly, contact support 117 is arranged movably—in such a manner that it can be shifted—on a contact holder 121 (FIGS. 10, 11, 12) upon which it can be latched in two mutually longitudinally offset positions in the plug-in direction X, whereby in one of these two latching positions, there is a greater interval to the contact holder 121 than in the others.

Contact holder 121 preferably also consists of synthetic substance and has a number of duct openings 122 that correspond to the number of male contacts 12, said duct openings 122 being flush with contacts 12.

Contact support 117 can be pre-latched in the position in which it has a greater distance to the contact holder 121. This "pre-latching position" is used for securely preassembling the conductor ends 115 with the male contacts 12 quickly and in a simple manner for which purpose the conductor ends 115 are stuck through the duct openings 118.

This can be done in various ways: For example, latch hooks 12 with sufficient length—in this case, four latch hooks—on one of the two structural parts 117, 121 in two mutually axially offset latch recesses 124*a, b*, where contact support 117 or contact holder 121 can be latched on the two structural parts (FIG. 10) or where are provided different latching means for different positions, in particular, means having designs that vary in terms of thickness to provide a secure hold against possible shifting (not illustrated here).

Figure 12A:
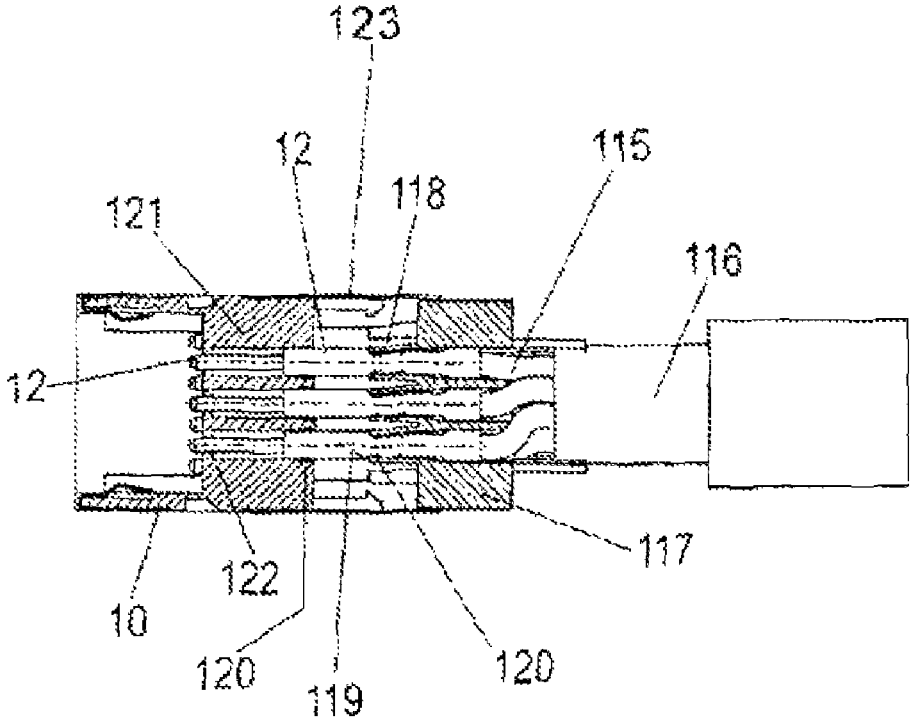
FIGS. 12*a* and 12*b* are sectional views of the jack contact support and contact holder members in the partially-assembled and fully assembled conditions, respectively.
Figure 12B:
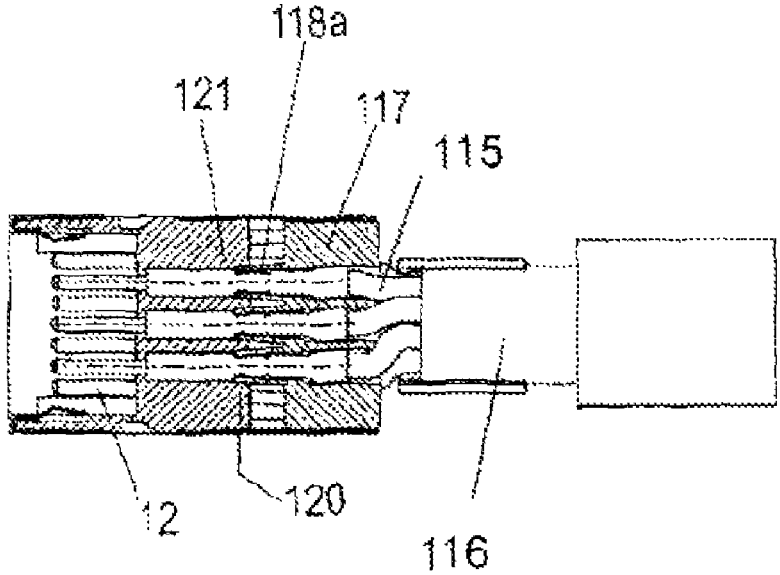
Figure 13:
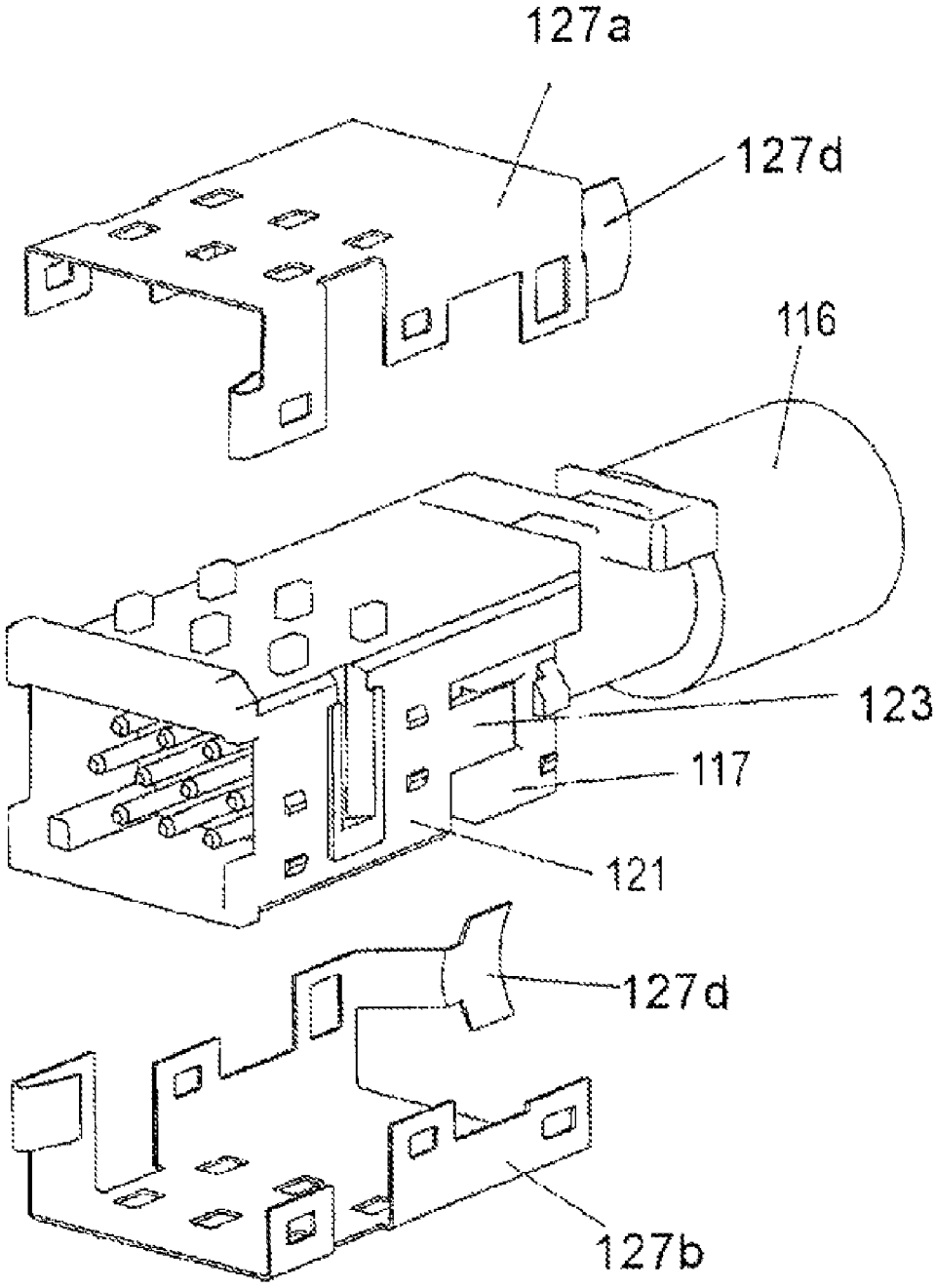
FIG. 13 is an exploded view of the jack contact mounting unit.
Figure 14B:
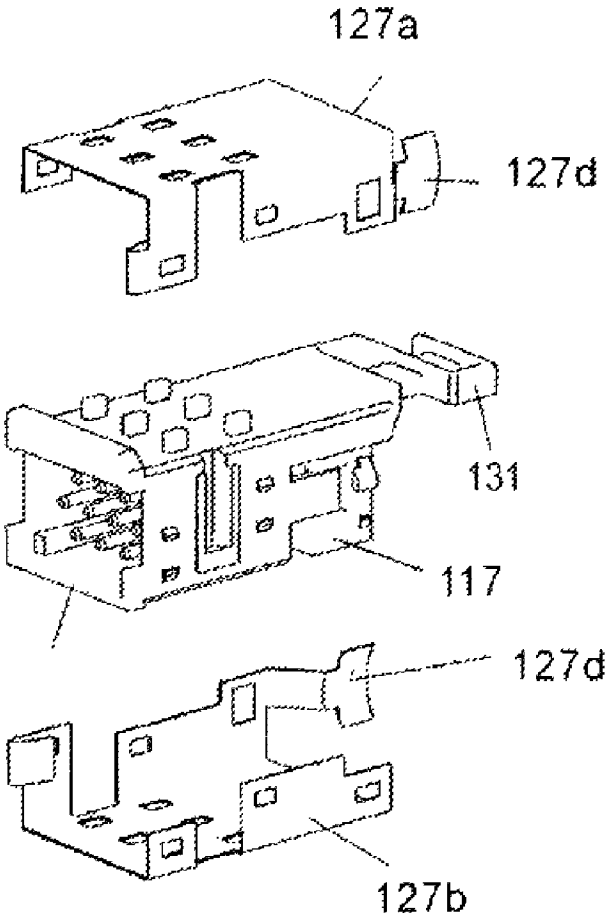
FIGS. 14*a* and 14*b* are perspective and exploded views, respectively, of the jack contact mounting unit.
Figure 14A:
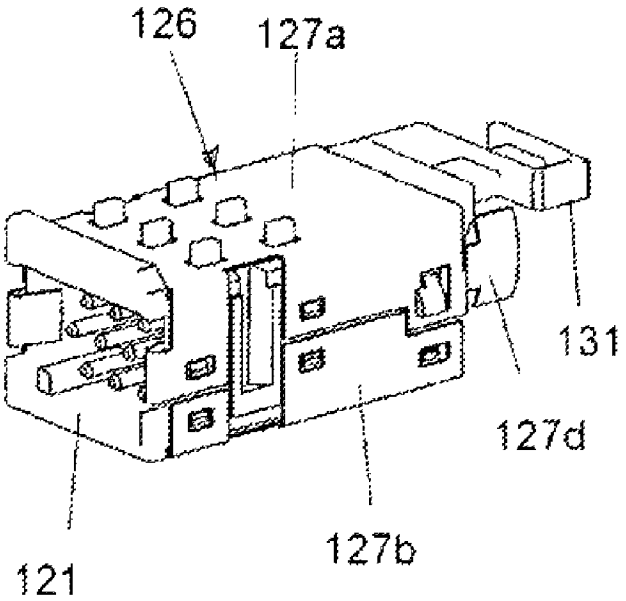

The guide-sleeve-like bridges 118*a* on the duct openings can be so designed that in this state, they will so dip into funnel 120 or again into similar corresponding contours in contact holder 121 that we can prevent any widening of the bridges 118*a* to the outside and so that in this way the latching of the pin contacts 10 in contact support 117 will be properly locked. After the preassembly of conductors 115, contact support 117 is shifted out of the "pre-latching position" into the "latching position" (FIGS. 12*a* and 12*b*).

Figure 15A:
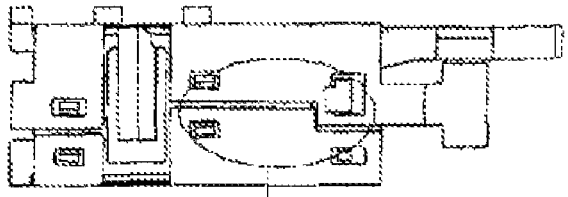
FIGS. 15*a*, 15*b*, and 15*c* are side elevation, top and detailed sectional views, respectively, of the jack contact mounting unit.
Figure 15B:
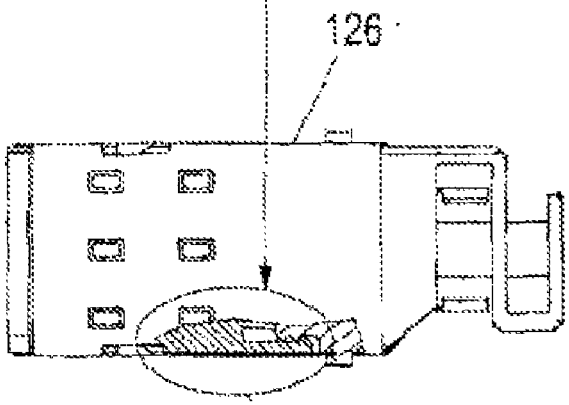
Figure 15C:
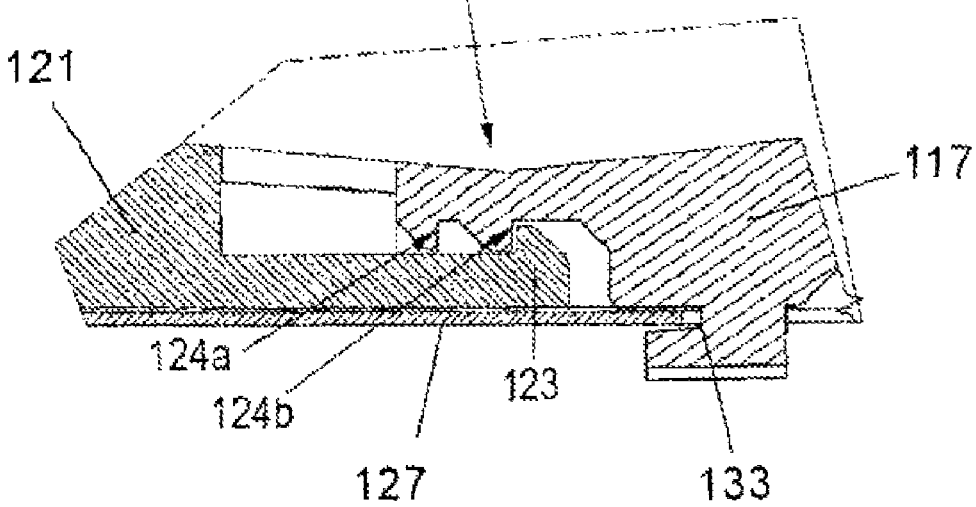
Figure 16:
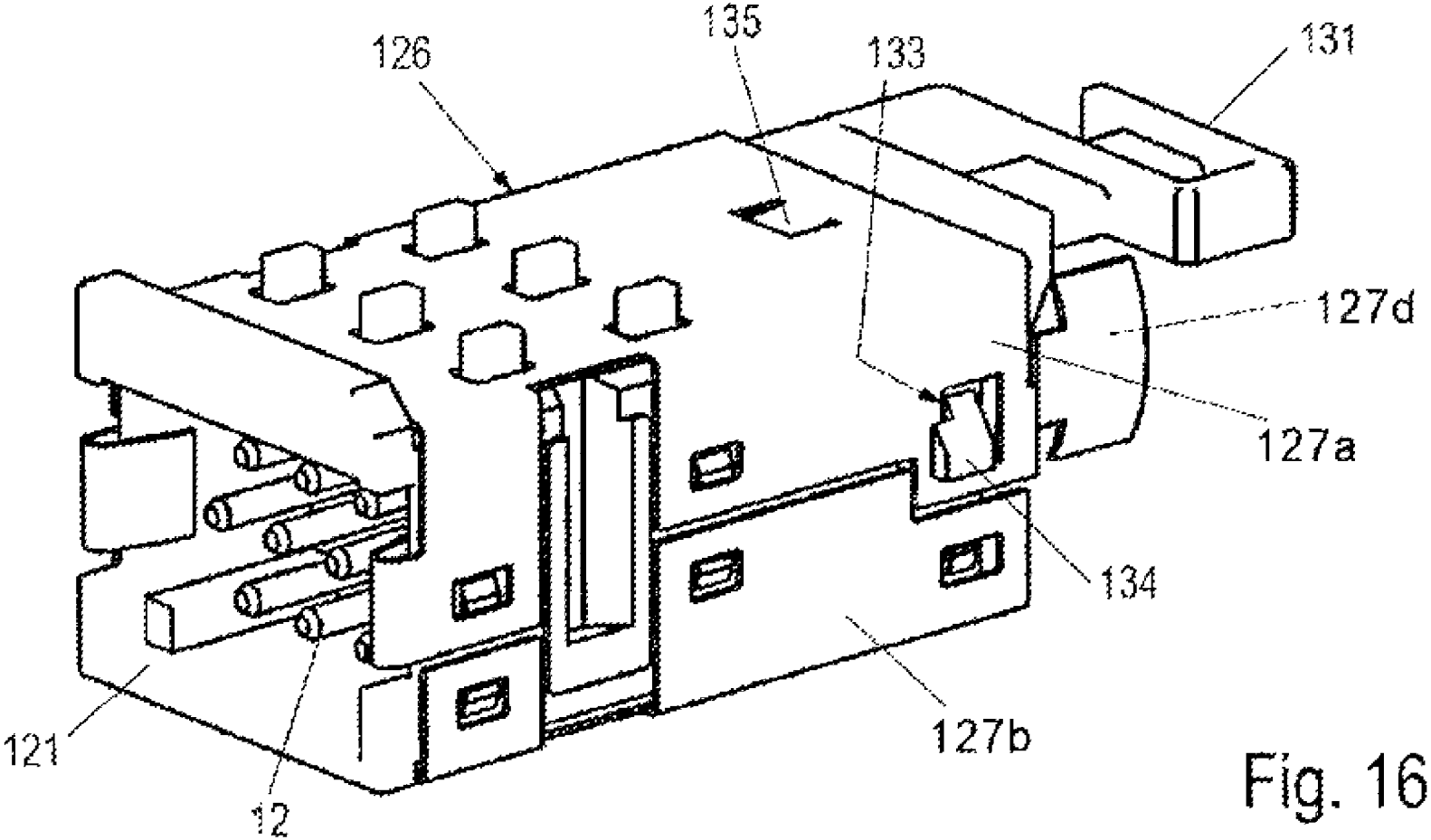
FIG. 16 is a perspective view of the jack contact mounting unit.
Figure 17:
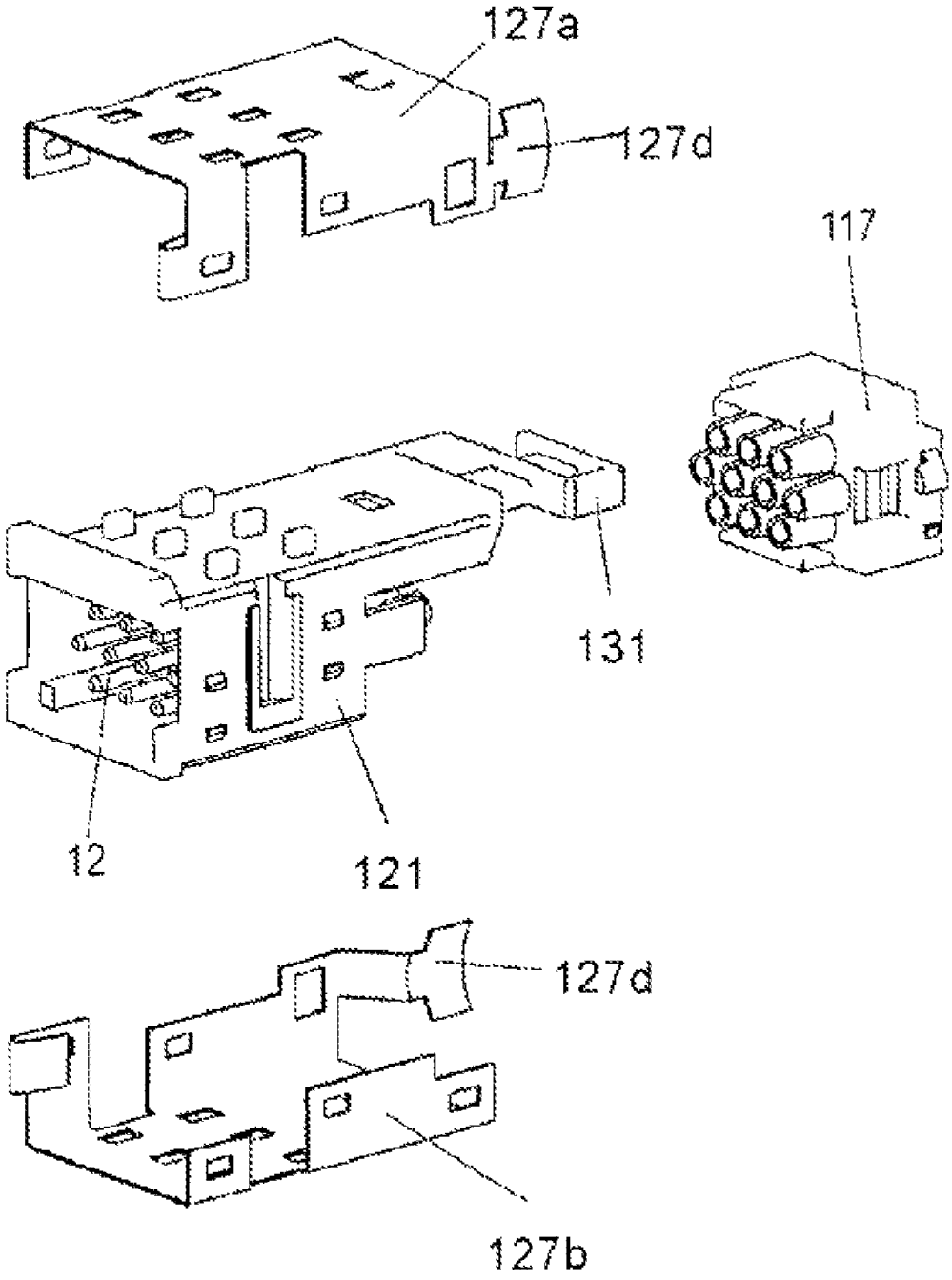
FIGS. 17 and 18 are exploded perspective views of the jack contact mounting unit.
Figure 18:
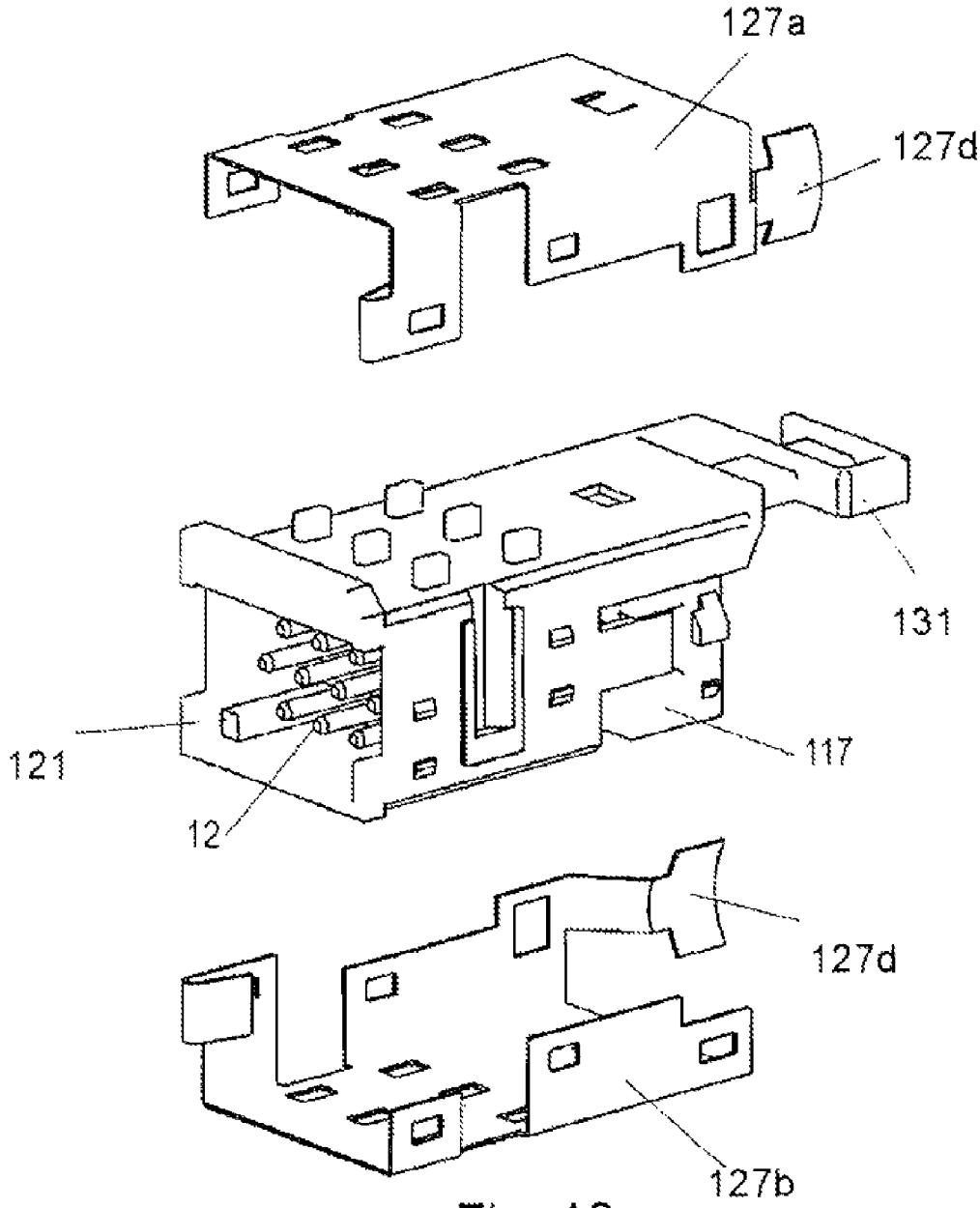
Figure 19A:
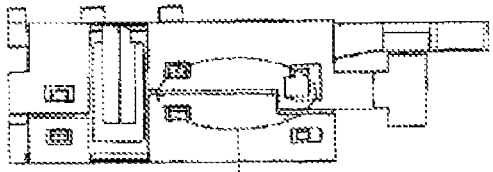
FIGS. 19*a*, 19*b* and 19*c* are side elevation, to and detailed sectional views, respectively, of the jack contact mounting unit of FIGS. 15*a*-15*c;*
Figure 19B:
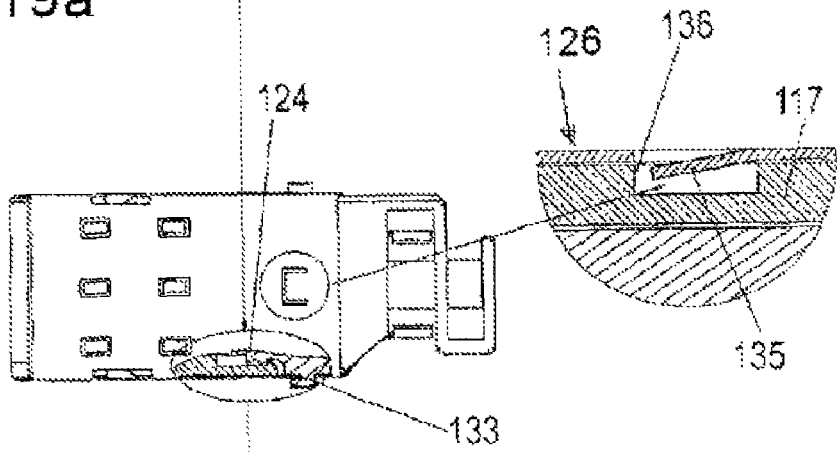
Figure 19C:
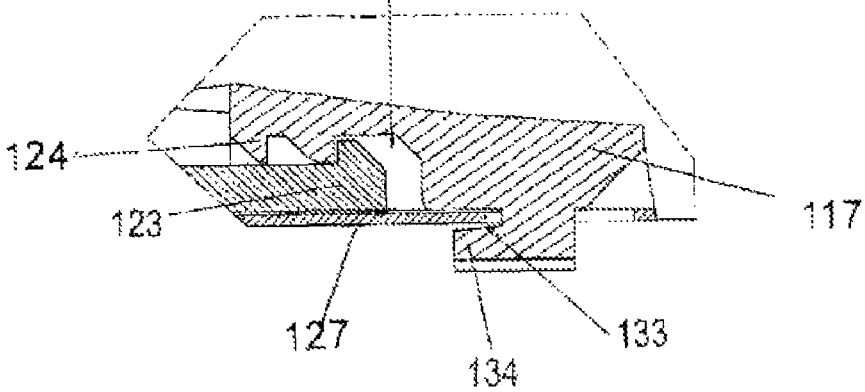
Figure 20A:
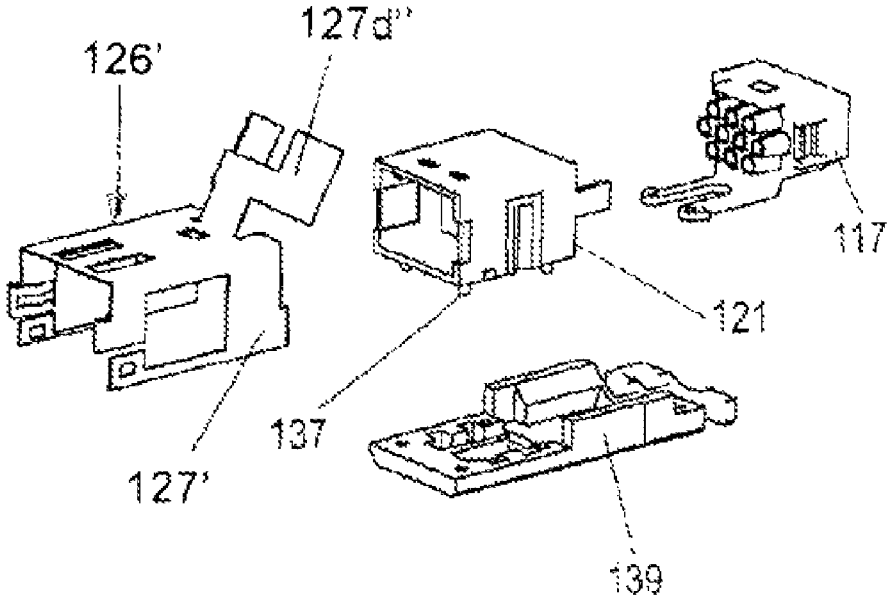
FIGS. 20*a* and 20*b* are top and bottom exploded perspective views, respectively, of a modification of the jack contact mounting unit including a zinc lower support plate.
Figure 20B:
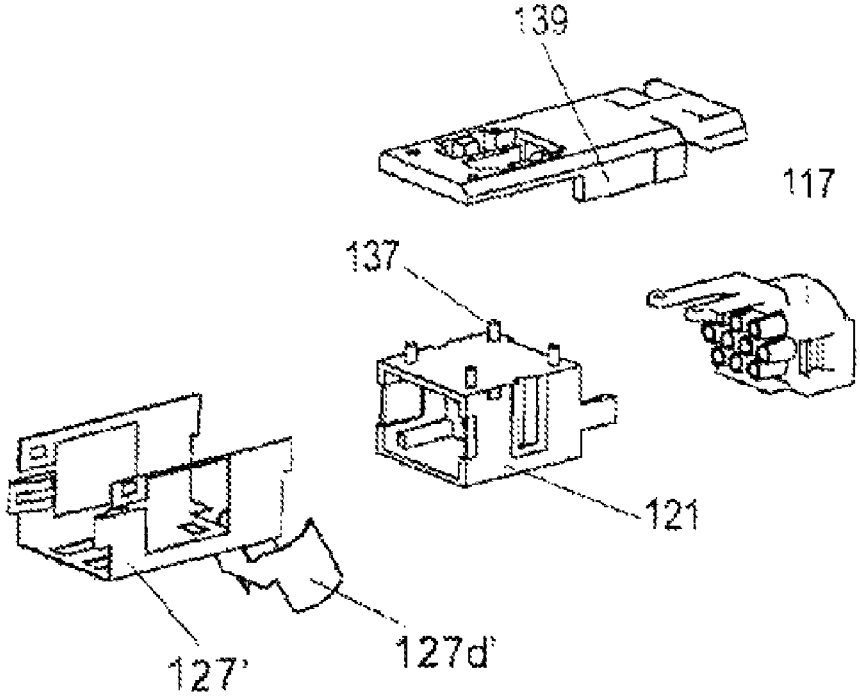
Figure 21A:
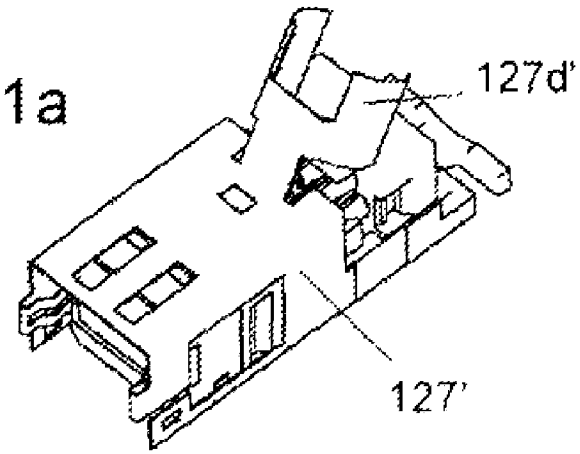
FIGS. 21*a* and 21*b* are top and bottom perspective views, respectively, of the apparatus of FIG. 20*a* in a partially assembled condition.
Figure 21B:
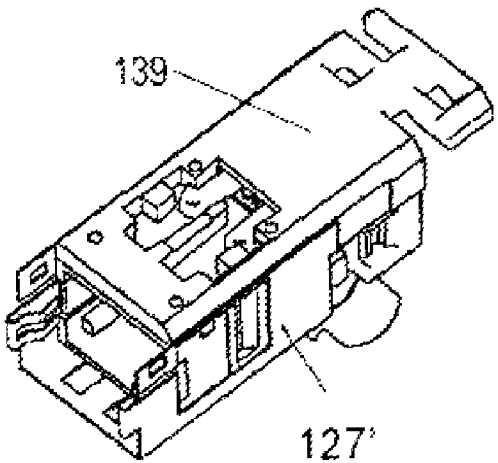
Figure 21C:
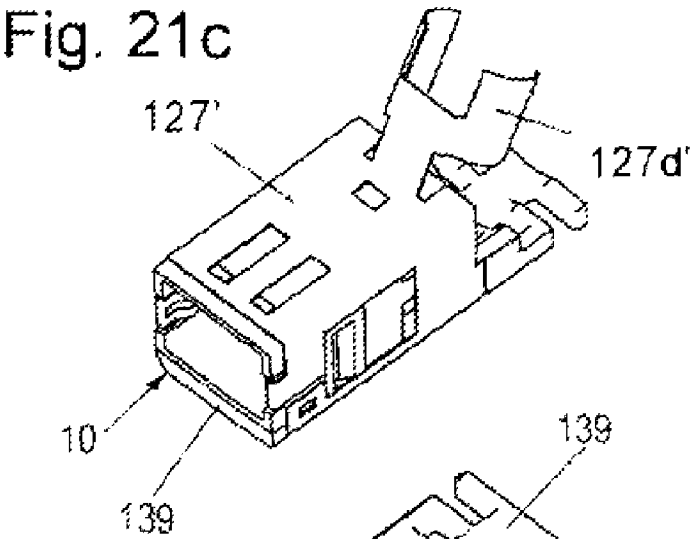
FIGS. 21*c* and 21*d* are top and bottom perspective views of the apparatus of FIG. 20*a* in the fully assembled condition.
Figure 21D:
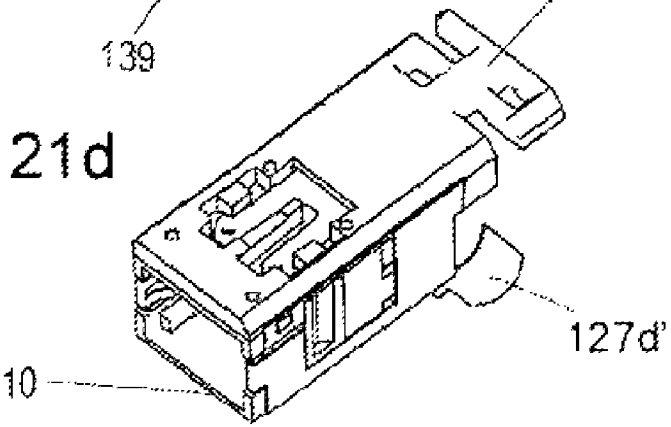

Referring to FIGS. 15*a*-15*c*, it will be seen that the metal shield means 126 extends into slot 133 to block the latch projection 123 from displacement from the latch opening when the contact support and contact holder elements are in the fully assembled condition. Catch means 135 and 136 (FIGS. 19*a*-19*c*) serve to lock the contact support member against displacement relative to the shield means 126.

Preferably, the latch hooks 123 are blocked in the terminal latching position in which contact support 117 is axially closer to the contact holder 121 with the duct openings. This function can be implemented, for example, with the help of the screen housing 126 if the screen sheet metal pieces 127 are so designed that, in the assembled position, they will so cover the latch hooks 123 toward the outer circumference so that the former cannot move out of the catch recesses 124*a,b* (FIG. 15).

Preferably, screen sheet metal pieces 27, 127 are designed so that they can be snapped on and then they are again latched on latch means on the plug or jack housing 9, 10. Screen housing 126 or a part of the housing can also be made in a movable fashion and can, in a blocking position, be pushed into and out of that position, whereby it is furthermore very advantageous when, during the shifting move into the blocking position, it engages an undercut or slit 133 of a clip 134 or the like so that it itself—securing the latch hook 128—is secured against any bending toward the outside, so that in a simple and advantageous manner, so to speak, we can put together a kind of "multiple" locking position for the latch hook 123 (FIGS. 16-19).

Figure 22D:
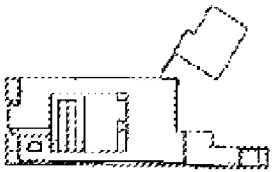
FIG. 22*d*-22*f* are corresponding views of the apparatus in the fully assembled condition.
Figure 22E:
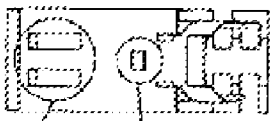
Figure 22F:
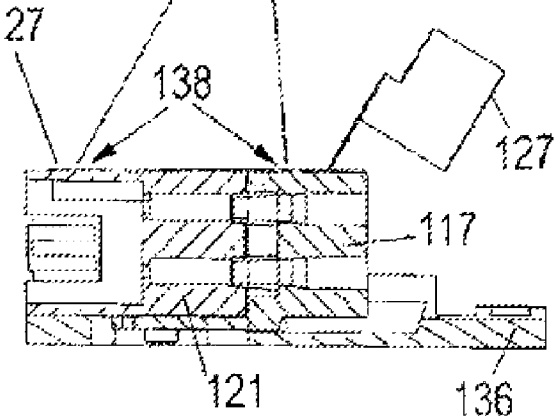
Figure 22A:
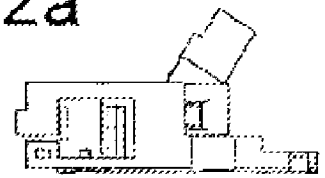
FIGS. 22*a*, 22*b* and 22*c* are side elevation, to, and longitudinal views, respectively, of the apparatus of FIG. 20 a in the partially assembled condition.
Figure 22B:
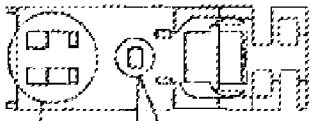
Figure 22C:
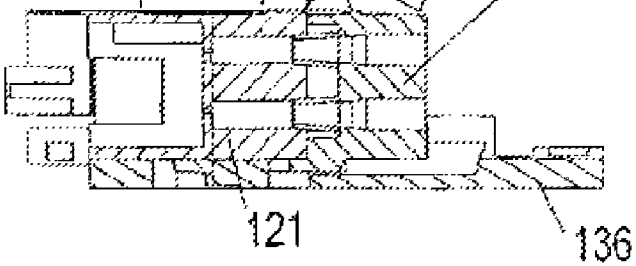

In the modification shown in FIGS. 20*a*, 20*b*, and 21*a*-21*d*, the shield means 126' includes a sheet metal U-shaped component 127', and a cast zinc bottom plate 139. After the jack contact mounting unit 10 is seated in the preassembled condition (FIGS. 22*a*-22*c*), on the plate 139 (FIGS. 21*a* and 21*b*), members are displaced together toward the locked fully assembled condition of FIGS. 22*d*-22*f*. The shield member 127 is then longitudinally displaced relative to the zinc plate 139 toward the locked condition of FIGS. 21*c* and 21*d*.

A sheet metal clip 135, which engages recess 126 of plug housing 9 or jack housing 10, can secure the screen housing itself against any shifting (FIG. 19).

FIG. 20 particularly clearly shows how screen housing 126 can be shifted. Here, screen housing 126 is made up of a screen sheet metal piece 127 and a zinc/die-cast lower part 139 upon which one can set the contact holder 121 using pegs 137. Furthermore, contact support 117 can be shifted relatively on contact holder 121 and on the zinc/die-cast lower part 136. The actual piece of screen sheet metal 127 is guided in a movable manner with the contact support 117 on contact holder 121, something that again further simplifies the handling and assembly. It can be moved out of a preassembly position shown in FIG. 22*a* into the terminal assembly position shown in FIG. 22*b* in which it can be latched upon contact holder 121 (latching means 138).

Figure 23A:
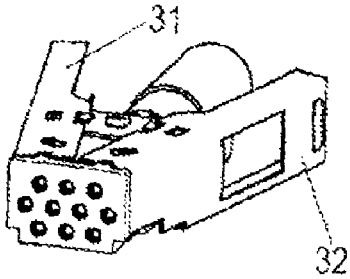
FIGS. 23*a*-23*e* are perspective views illustrating the connecting steps for fastening another embodiment of a shield member to a contact mounting unit.
Figure 23B:
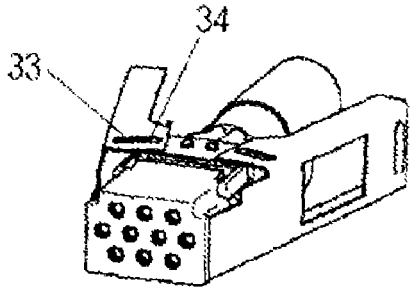
Figure 23C:
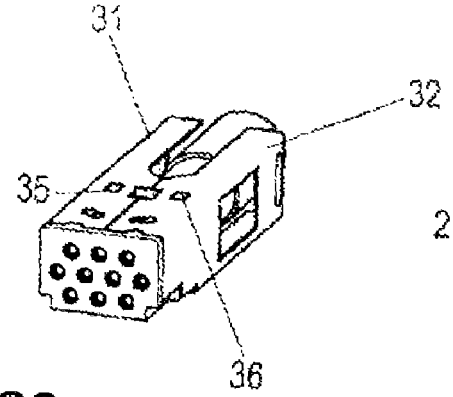
Figure 23D:
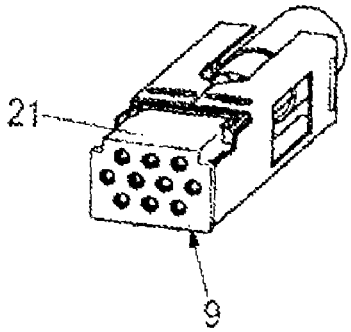
Figure 23E:
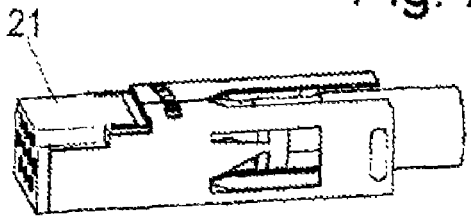

Referring to FIGS. 23*a*-23*e*, the sheet metal shield means can include a pair of arm sections 31 and 32 that are pivotally connected by pivot pins 34 and slots 33 with a body section 35. Thus, when the arm sections are pivoted together, the shield means is fasted to the contact mounting unit as shown in FIG. 23*e*.

Figure 24A:
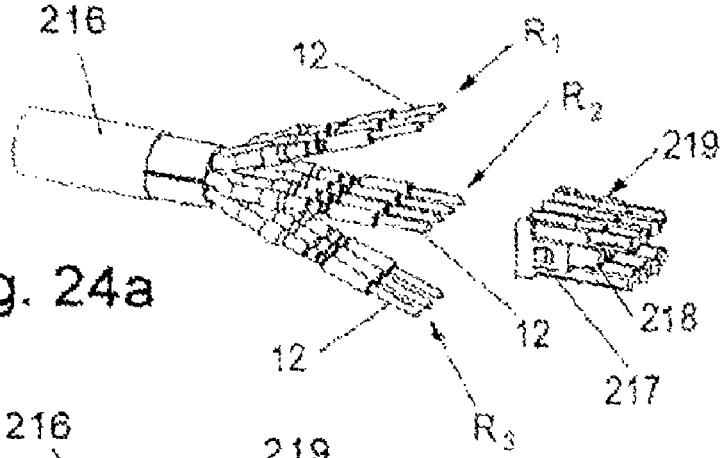
FIGS. 24*a*-24*f* illustrate the steps for assembling another embodiment of the invention.
Figure 24B:
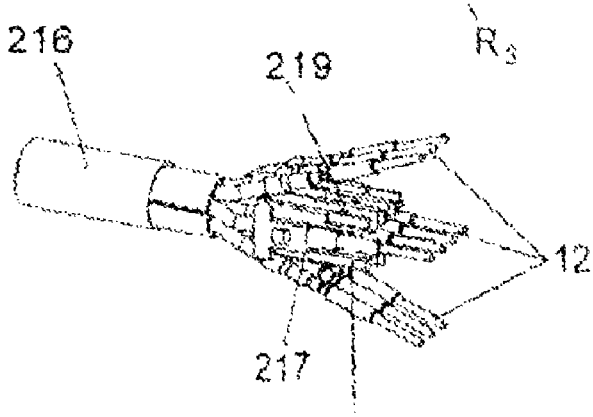
Figure 24C:
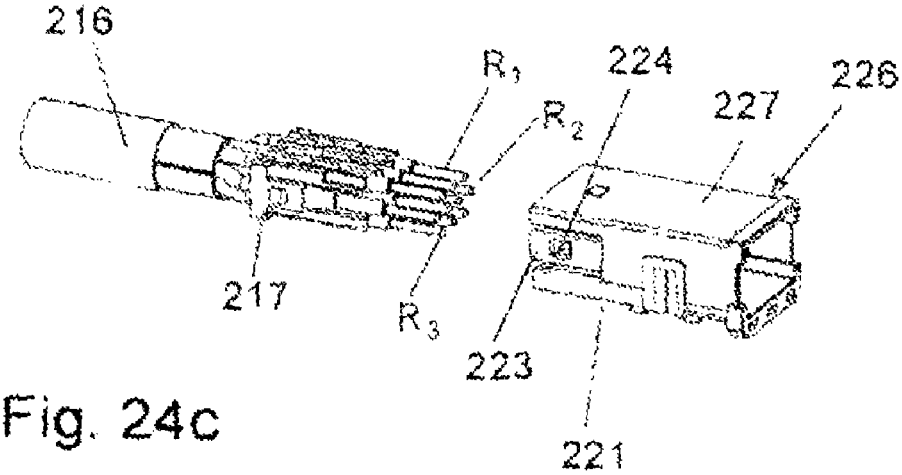
Figure 24D:
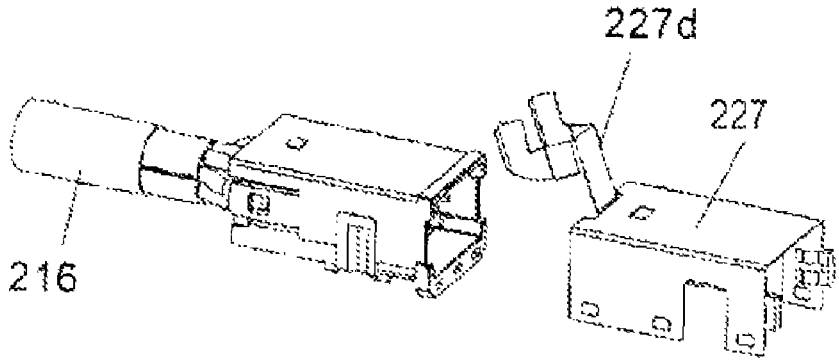
Figure 24E:
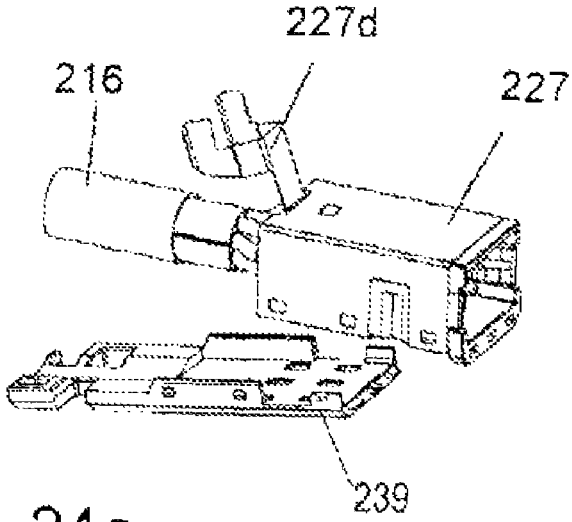
Figure 24F:
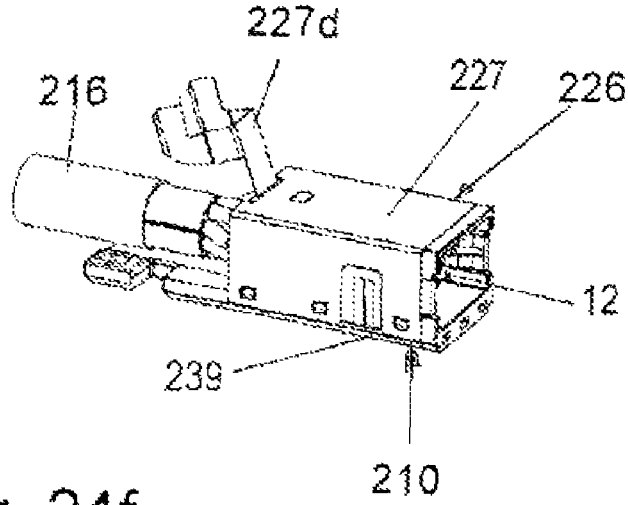

In the embodiment of FIGS. 24*a*-24*f*, contact support member 217 is provided with a plurality of through passages 218 for receiving the contacts of a center row R2, respectively, and a plurality of longitudinal grooves 219 in its upper and lower external surfaces for receiving the contacts of the outer rows R1 and 3, respectively. The contact holder member 221 in this case contains a through chamber 221*a* (FIG. 24*c*) that receives the contact support member 217 (FIG. 24*d*) and thereby retains the outer contacts 12 in the grooves 219. The upper shield plate 227 is then positioned in place (FIG. 24*e*), and the lower zinc shield plate 239 is fastened to the assembly (FIG. 24*f*).

While in accordance with the provisions of the Patent Statutes the preferred forms and embodiments of the invention have been illustrated and described, it will be apparent to those skilled in the art that changes may be made without deviating from the invention described above.

What is claimed is:

1. A plug and jack electrical connector arrangement for connecting together the conductors (15; 115) of a pair of cables (16; 116), comprising:

(a) a housing (4; 5) containing an open-ended chamber having a first end for receiving one cable end;

(b) a plurality of cylindrical contacts (11; 12) connected with the bare ends of the conductors of the cable, respectively;

(c) a contact support member (17; 117; 217) containing a plurality of parallel longitudinal support passages (18; 118; 218) terminating at one end in corresponding outwardly projecting resilient guide sleeve portions (18*a*, 118*a*; 218*a*), respectively, said contacts being mounted concentrically within, and having free ends projecting collinearly outwardly from, said guide sleeve portions, respectively;

(d) a contact holder member (21; 121; 221) containing a plurality of parallel longitudinal holder passages (20; 120; 220) collinearly arranged opposite said sleeve projections, respectively; and (e) a latch arrangement for positioning said contact holder member longitudinally relative to said contact support member, including:

(1) at least one latch hook (23; 123) connected with one of said contact holder and contact support members and extending longitudinally in the direction of the other of said contact holder and contact support members;

(2) a first recess (24*a*; 124*a*) arranged in the other of said contact holder and contact support members for engagement with said latch hook when said members are longitudinally displaced toward a first partially-assembled spaced condition in which said contact free ends extend partially into the adjacent ends of said support passages, respectively; and (3) a second recess (24*b*; 124*b*) arranged in said other member for engagement with said latch hook when said members are longitudinally displaced toward a completely assembled contiguous condition, thereby to cause said resilient guide sleeve portions (18*a*; 118*a*) to extend partially into said passages contained in said contact holder member, respectively, whereby said contacts are locked in said holder passages, respectively;

(f) said completely assembled contact holder and contact support members defining a contact mounting unit (9; 10; 210) that is mounted within the other end of said housing chamber.

2. A plug and jack electrical connector arrangement as defined in claim 1, wherein said contact support member (217) contains a plurality of parallel longitudinal passages (218), and a plurality of longitudinal external grooves (219), some of said contacts extending through said passages, and some of said contacts being supported in said grooves, respectively; and further wherein said contact holder member (221) contains a through chamber for concentrically receiving said contact support member and said contacts, thereby to maintain said contacts in said grooves.

3. A plug and jack electrical connector arrangement as defined in claim 1, wherein said contacts are female contacts (11).

4. A plug and jack electrical connector arrangement as defined in claim 1, wherein said contacts are male contacts (12).

5. A plug and jack electrical connector arrangement as defined in claim 1, wherein said contact support member (217) also contains a plurality of longitudinal external grooves (219), some of said contacts being supported in said passages, and some of said contacts being supported in said grooves, respectively.

6. A plug and jack electrical connector arrangement as defined in claim 5, wherein said contact mounting means further includes:

(4) a zinc support plate (239) connected with the bottom of said mounting unit.

7. A plug and jack electrical connector arrangement as defined in claim 1, wherein said housing chamber and said contact mounting unit have corresponding generally rectangular cross-sectional configurations; and further wherein said contacts are arranged in horizontal rows.

8. A plug and jack electrical connector arrangement as defined in claim 7, wherein said contact member is rectangular; and further wherein a latch arrangement is provided at each of the four corners of said contact mounting member.

9. A plug and jack electrical connector arrangement as defined in claim 1, wherein said guide sleeve portions are axially-slit.

10. A plug and jack electrical connector arrangement as defined in claim 9, wherein said sleeve portions extend with a force fit within said bores, respectively.

11. A plug and jack electrical connector arrangement as defined in claim 10, wherein the end portions of said contact holder member bores adjacent said contact support member are constricted to define guide funnels (20; 120).

12. A plug and jack electrical connector arrangement as defined in claim 1, and further including:

(d) a sheet metal shield device (26; 126) for at least partially enclosing and electrically shielding said contact mounting unit and said latch arrangement.

13. A plug and jack electrical connector arrangement as defined in claim 12, wherein said metal shield device includes a zinc support plate (139) connected with the bottom of said mounting unit.

14. A plug and jack electrical connector arrangement as defined in claim 12, wherein said shield device includes a plurality of sheet metal sections (127, 127*a*).

15. A plug and jack electrical connector arrangement as defined in claim 14, wherein at least some of said sheet metal sections (31, 32) are pivotally connected together.

16. A plug and jack electrical connector arrangement as defined in claim 12, and further including a stop arrangement (133, 134) affording limited axial displacement of one of said contact support and contact holder members relative to said shield device.

17. A plug and jack electrical connector arrangement as defined in claim 16, and further including flap and slot means (135, 136) for limiting the axial displacement of said shield device relative to said contact mounting unit.

* * * * *